US009187151B2

(12) United States Patent
Garthwaite

(10) Patent No.: US 9,187,151 B2
(45) Date of Patent: Nov. 17, 2015

(54) HUMAN POWERED WATERCRAFT WITH FIN PROPULSION

(71) Applicant: Martin Spencer Garthwaite, Bainbridge Island, WA (US)

(72) Inventor: Martin Spencer Garthwaite, Bainbridge Island, WA (US)

( * ) Notice: Subject to any disclaimer, the term of this patent is extended or adjusted under 35 U.S.C. 154(b) by 0 days.

(21) Appl. No.: 14/216,635

(22) Filed: Mar. 17, 2014

(65) Prior Publication Data

US 2014/0261129 A1 Sep. 18, 2014

Related U.S. Application Data

(60) Provisional application No. 61/799,540, filed on Mar. 15, 2013, provisional application No. 61/818,964, filed on May 3, 2013, provisional application No. 61/915,909, filed on Dec. 13, 2013.

(51) Int. Cl.

| | |
|---|---|
| ***B63B 1/12*** | (2006.01) |
| ***B63B 1/14*** | (2006.01) |
| ***B63H 25/02*** | (2006.01) |
| ***B63B 43/14*** | (2006.01) |
| ***B63H 1/36*** | (2006.01) |
| ***B63H 16/00*** | (2006.01) |

(52) U.S. Cl.

CPC . *B63B 1/125* (2013.01); *B63B 1/14* (2013.01); *B63B 43/14* (2013.01); *B63H 1/36* (2013.01); *B63H 16/00* (2013.01); *B63H 25/02* (2013.01); *B63B 2001/145* (2013.01)

(58) Field of Classification Search

CPC ..... B63B 1/125; B63B 35/73; B63H 25/50; B63H 16/06; B63H 16/12

USPC ..... 114/121, 123; 440/13, 14, 21

See application file for complete search history.

(56) References Cited

U.S. PATENT DOCUMENTS 4,432,735 A * 2/1984 David ..... 440/21
6,964,589 B1 * 11/2005 Lin ..... 440/14

* cited by examiner

*Primary Examiner* — Lars A Olson

(57) ABSTRACT

A human-powered watercraft comprises a fin, a displacement body, and an outrigger, wherein the outrigger floats separately from the watercraft within a vertically oriented tube, which tube allows the outrigger to rise up and down relative to the watercraft while maintaining the relative orientation of the watercraft.

20 Claims, 25 Drawing Sheets

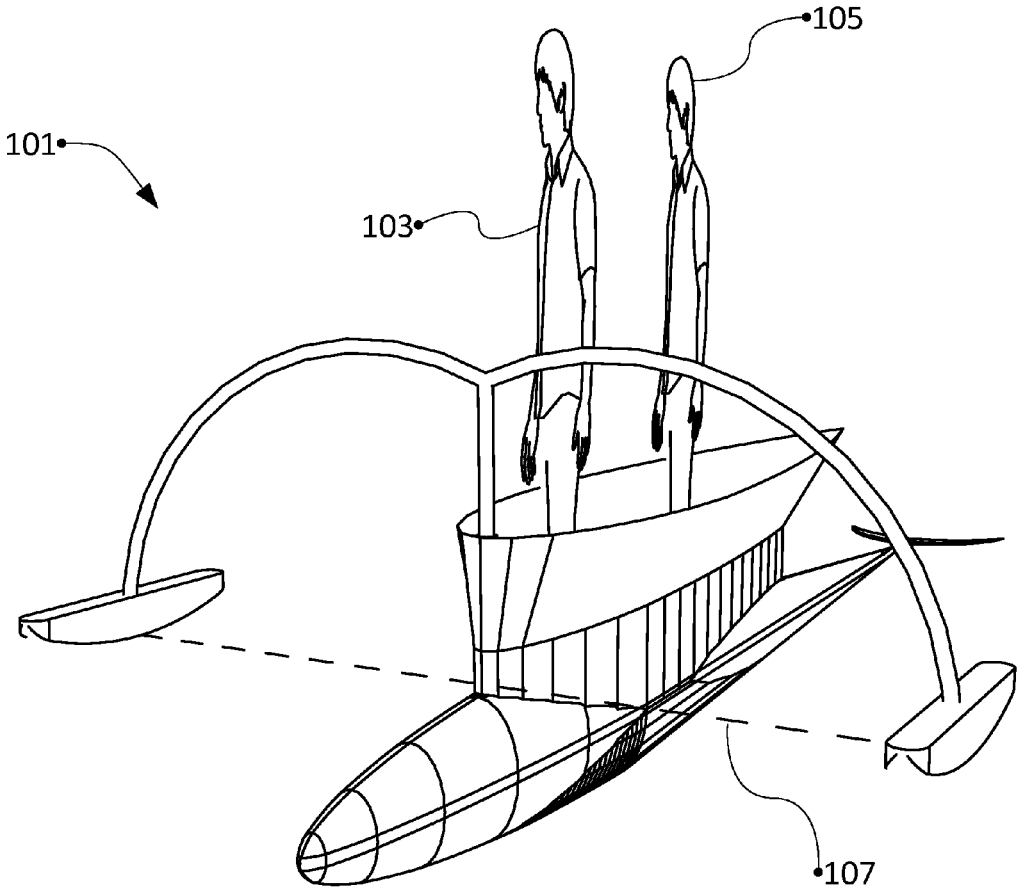
Figure 1.A

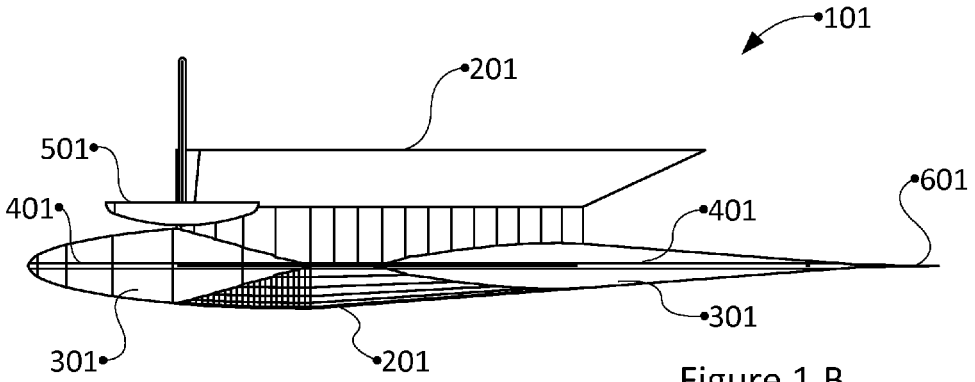
Figure 1.B
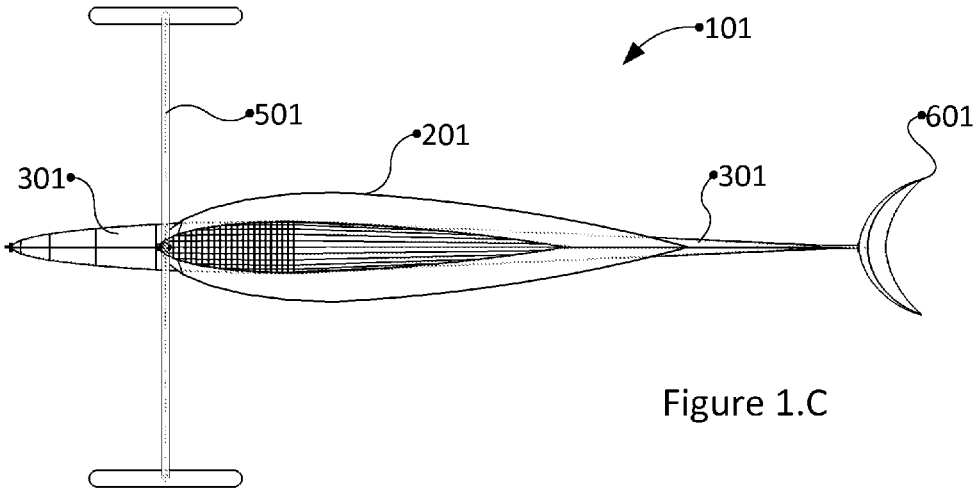
Figure 1.C
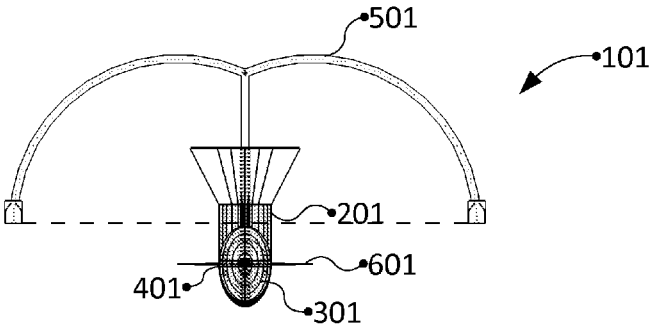
Figure 1.D

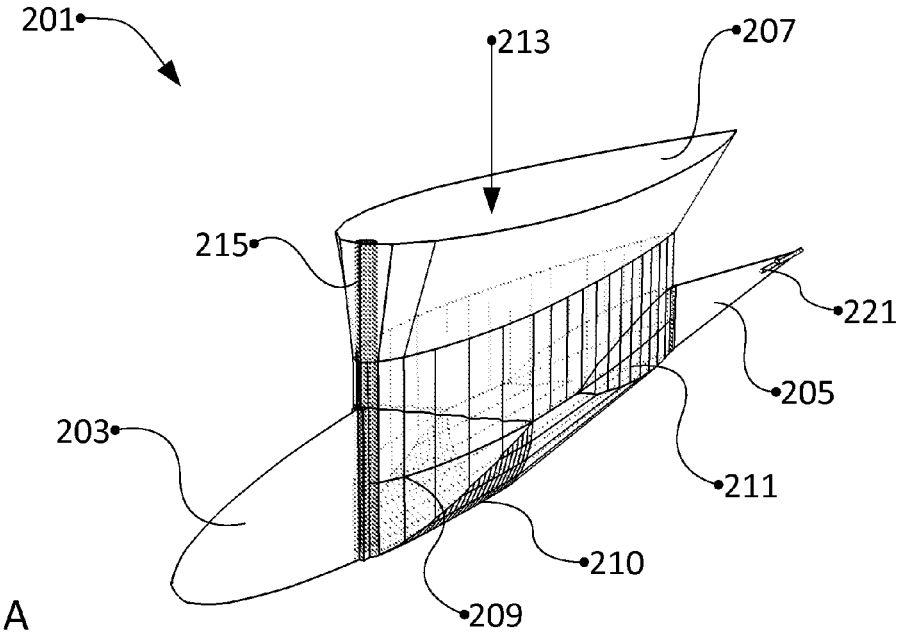
Figure 2.A

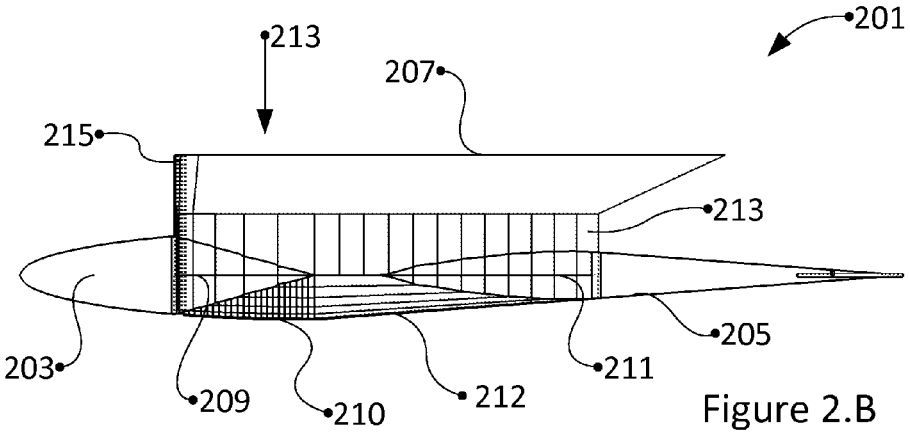
Figure 2.B
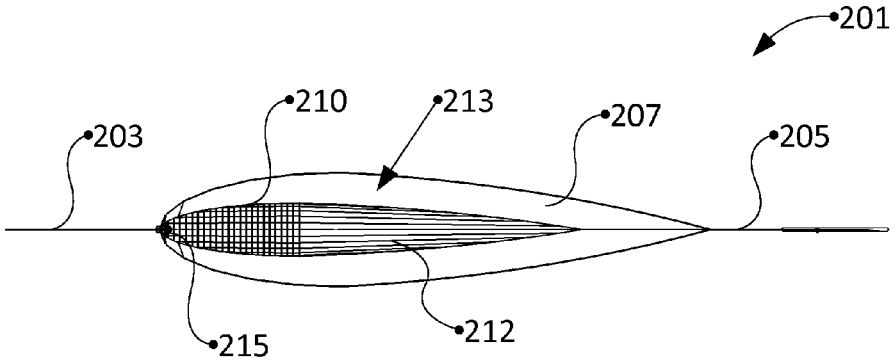
Figure 2.C
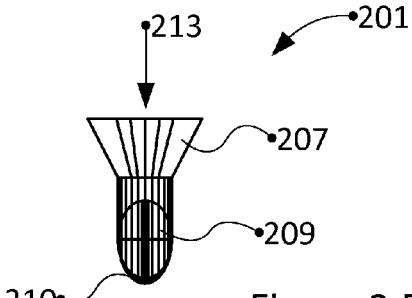
Figure 2.D
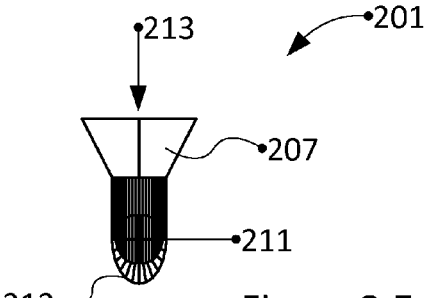
Figure 2.E

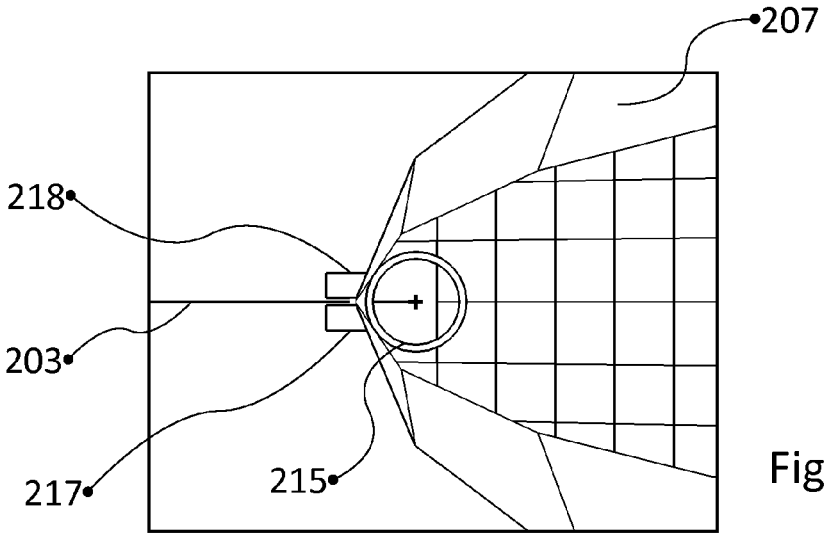
Figure 2.F
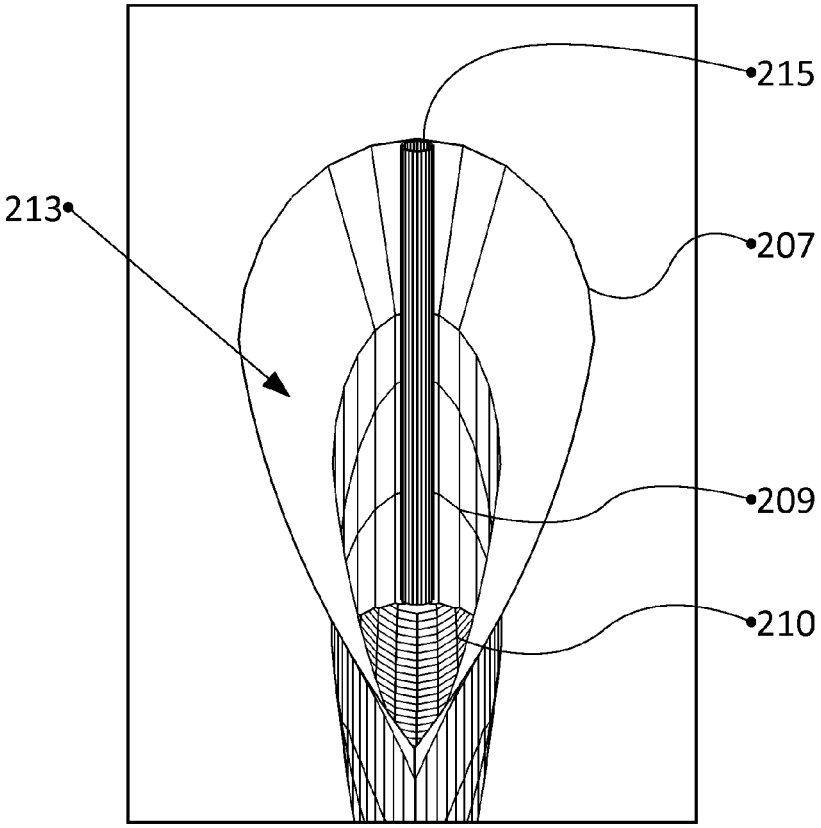
Figure 2.G

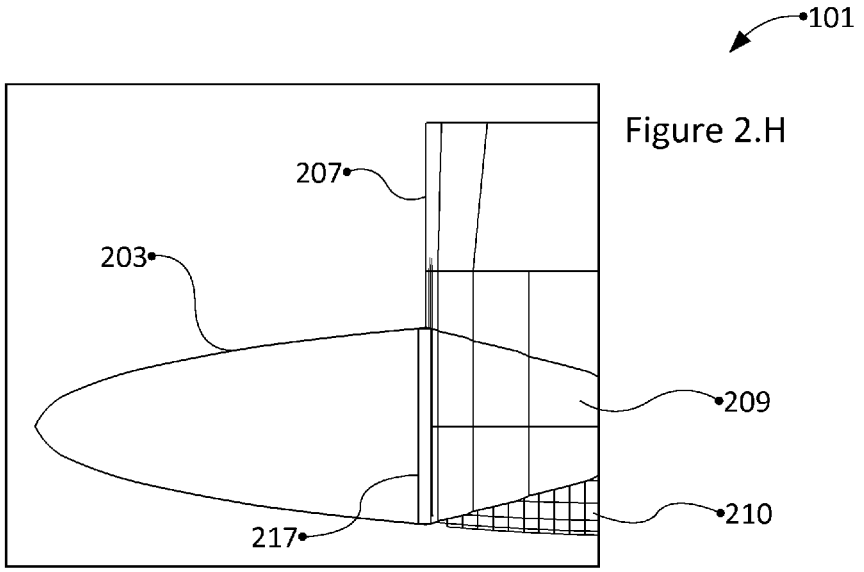
Figure 2.H
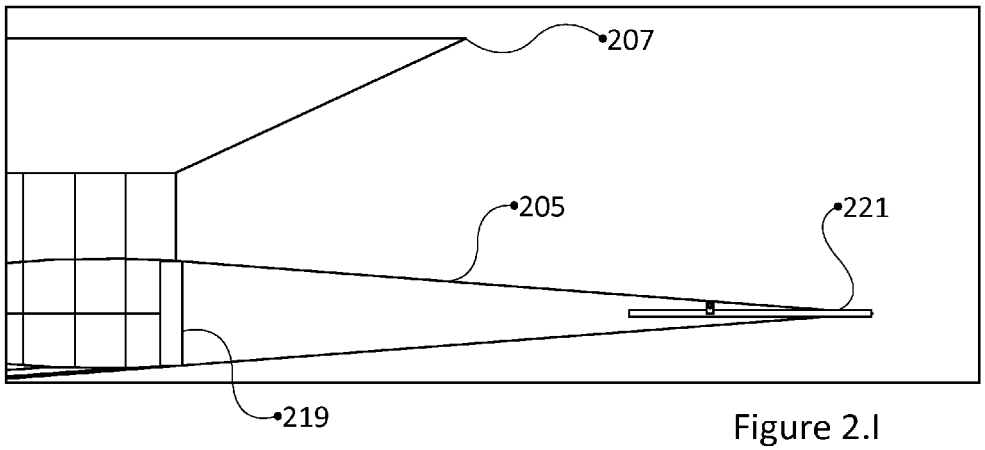
Figure 2.I
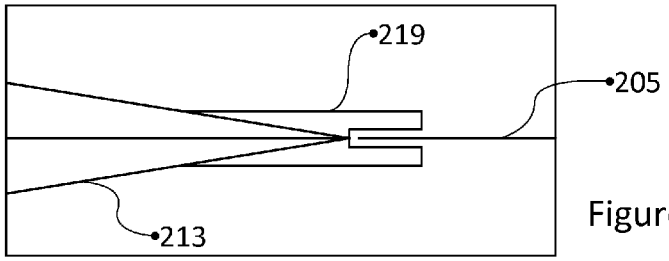
Figure 2.J

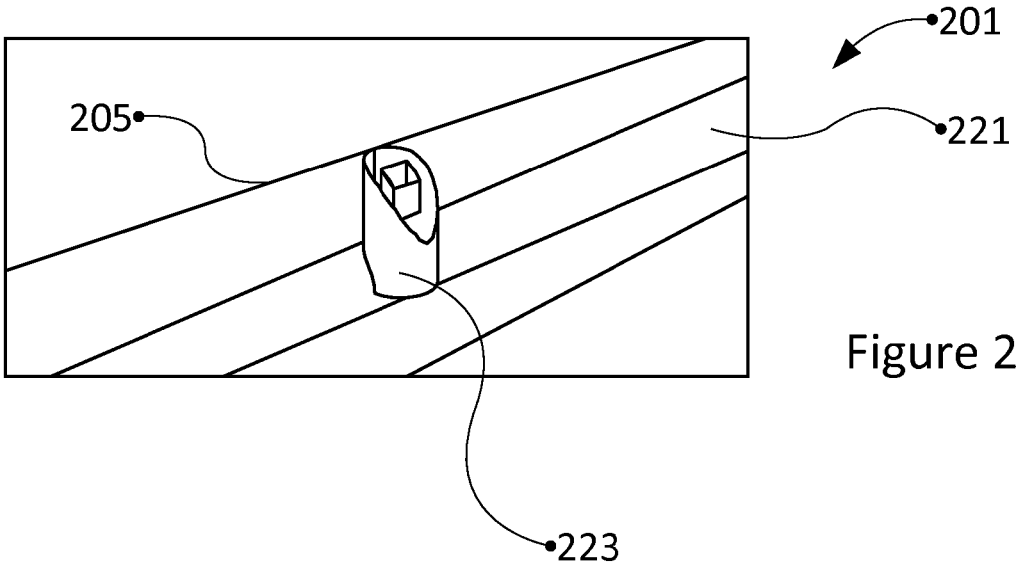
Figure 2.K

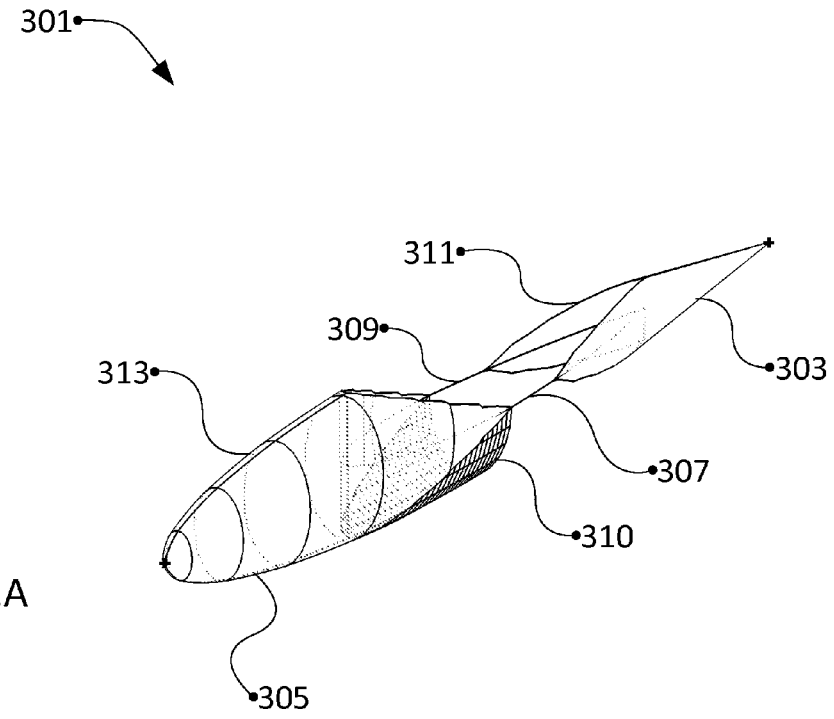
Figure 3.A

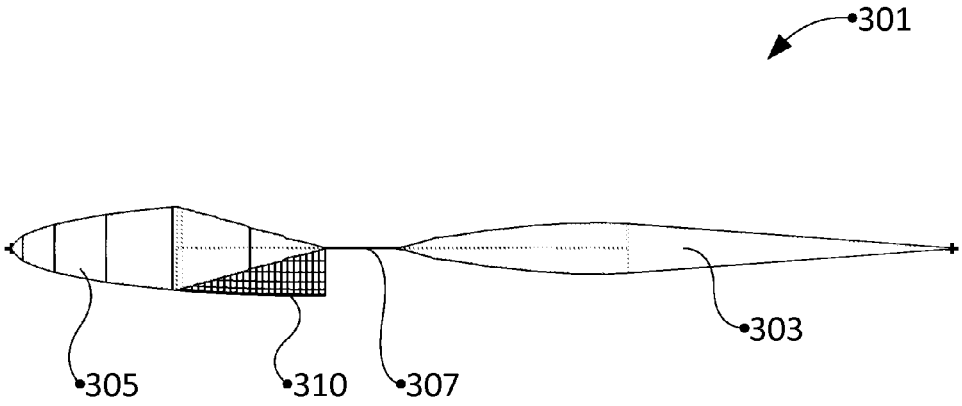
Figure 3.B
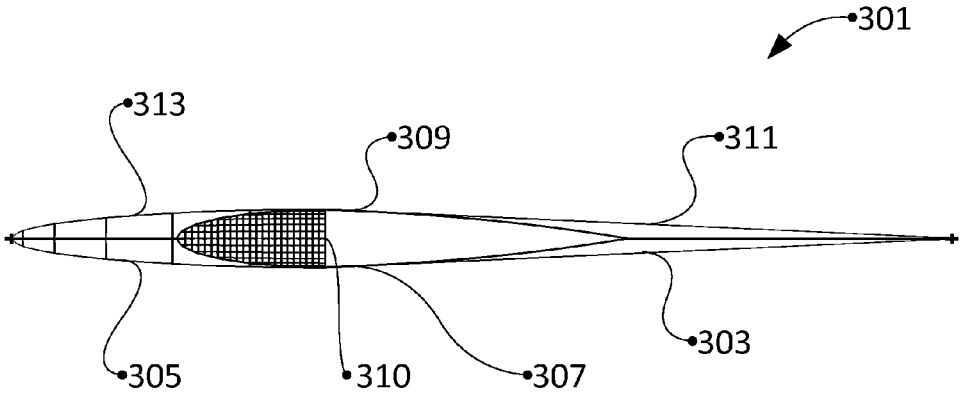
Figure 3.C
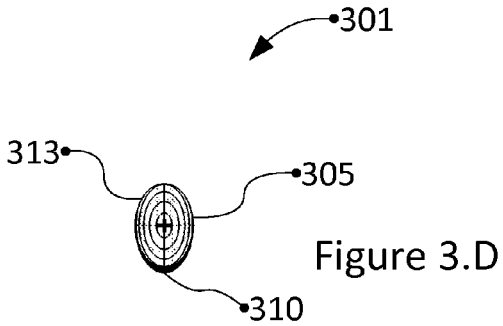
Figure 3.D
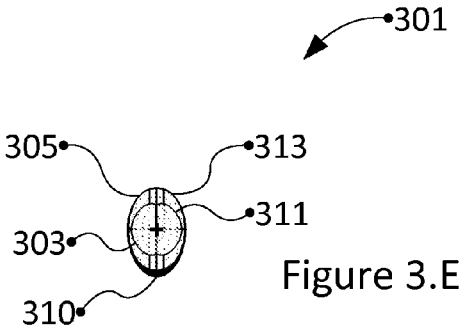
Figure 3.E

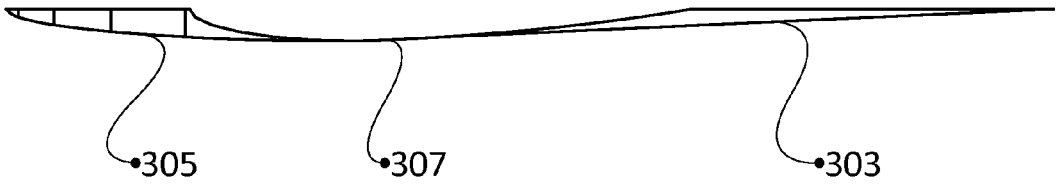
Figure 3.F
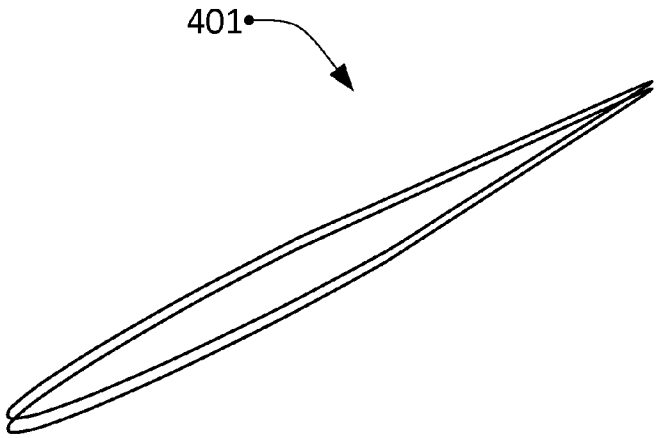
Figure 4

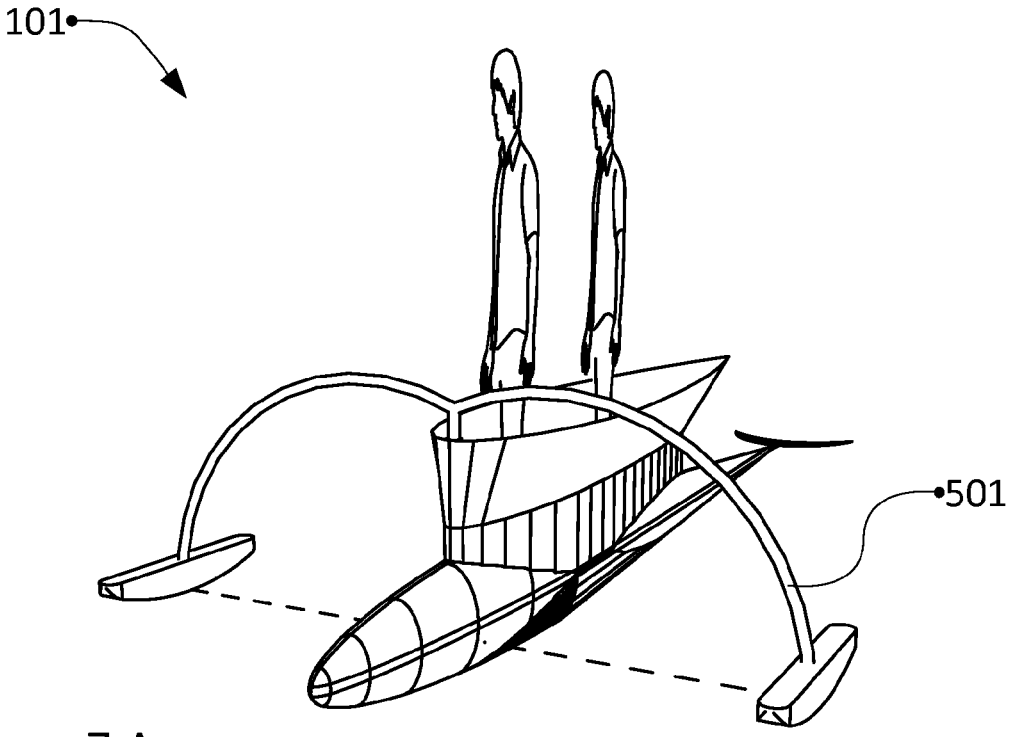
Figure 7.A
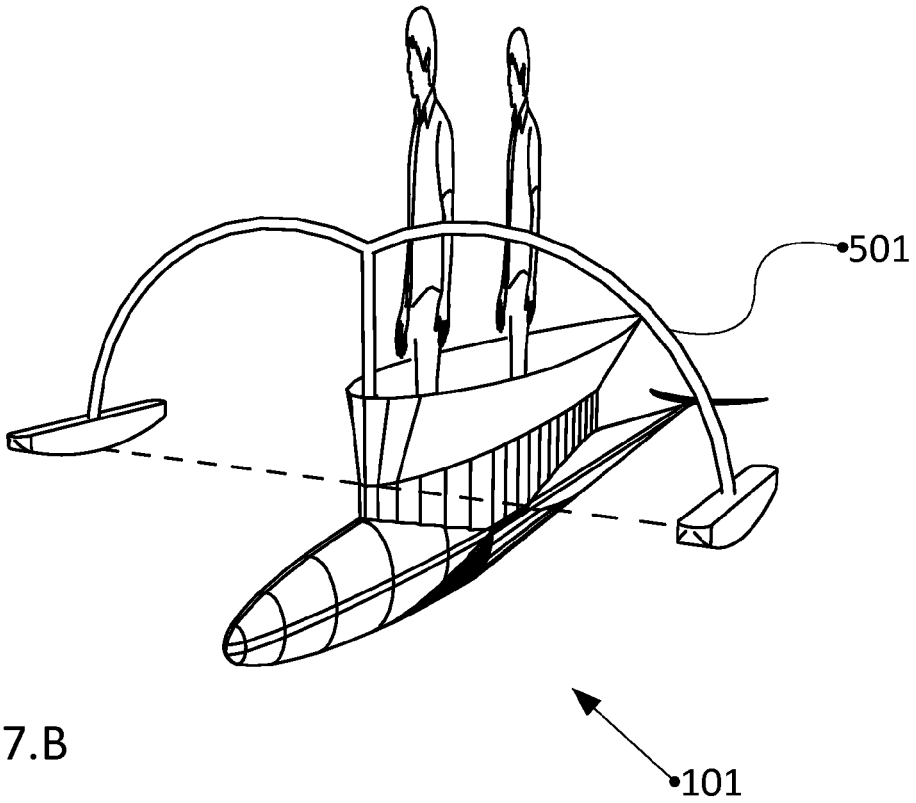
Figure 7.B

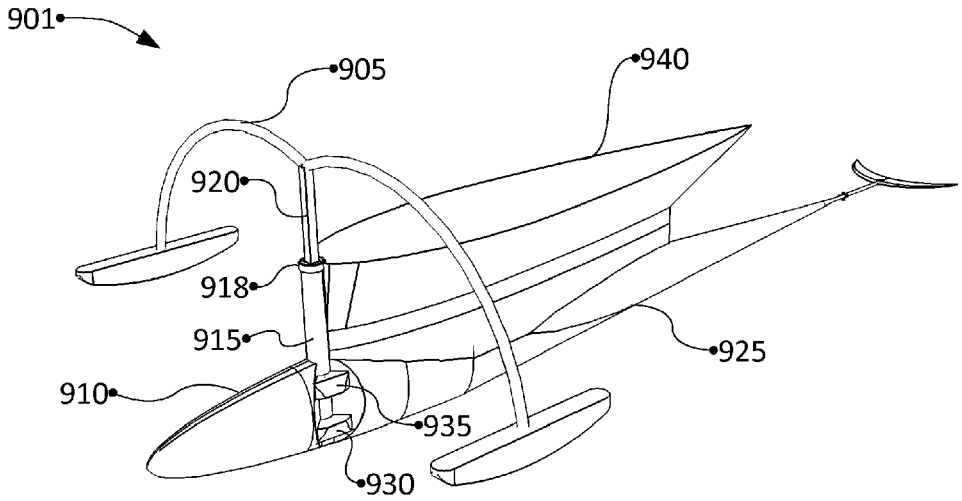
Figure 9.A
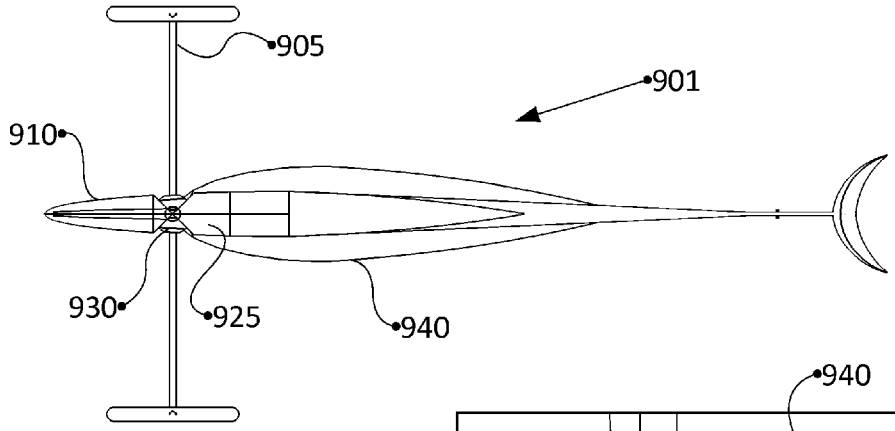
Figure 9.B
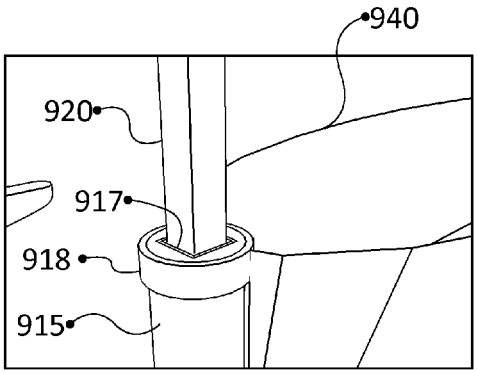
Figure 9.C

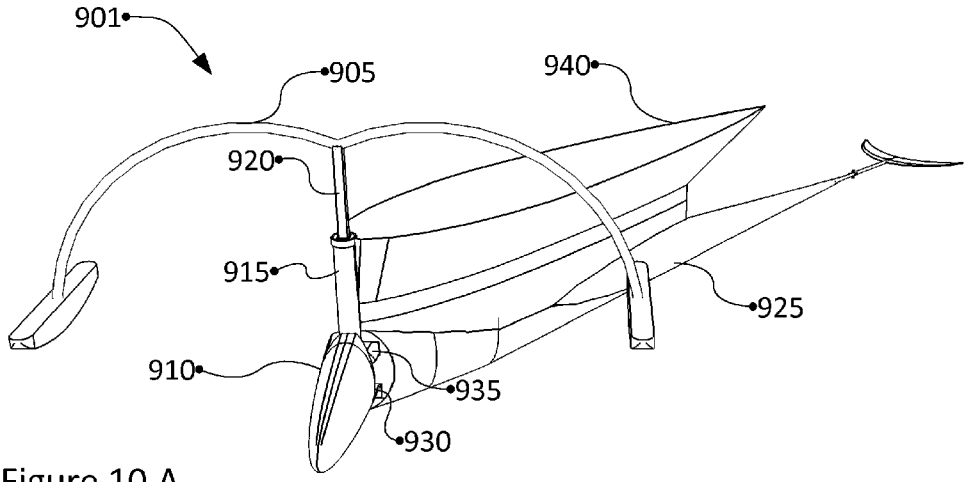
Figure 10.A
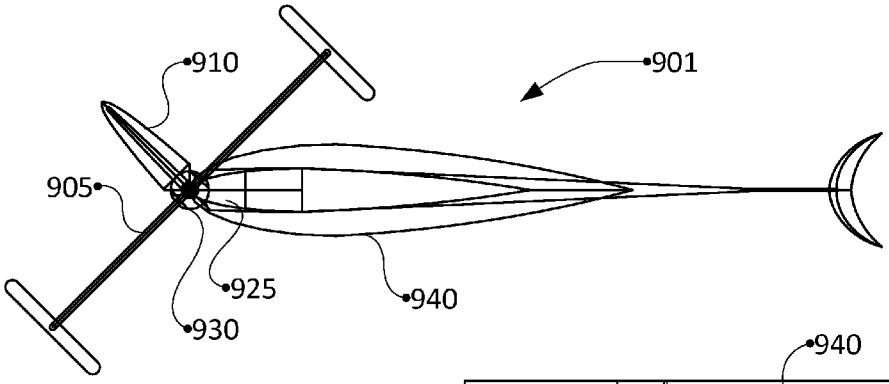
Figure 10.B
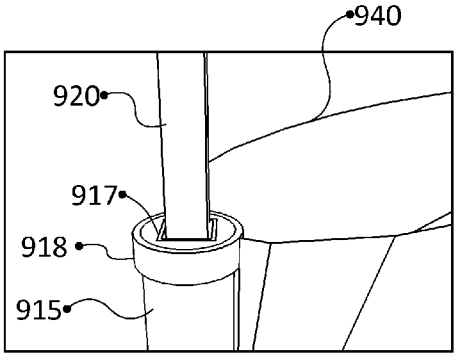
Figure 10.C

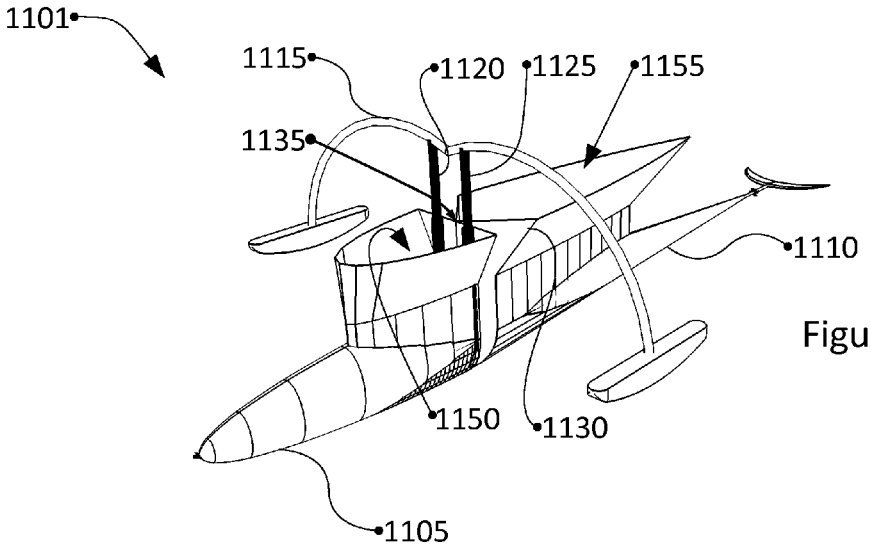
Figure 11.A
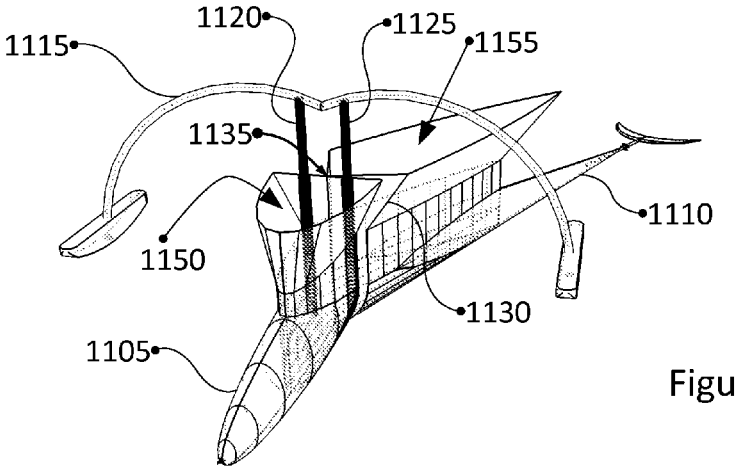
Figure 11.B

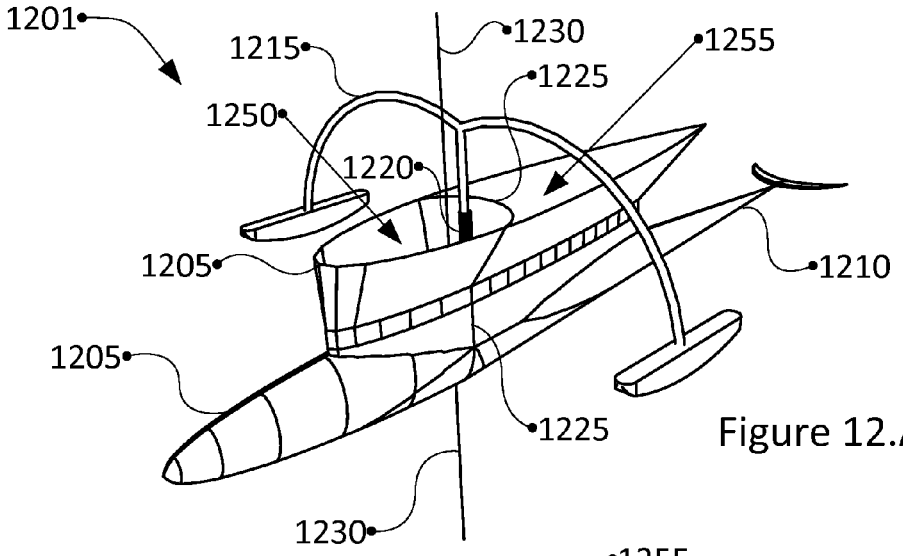
Figure 12.A
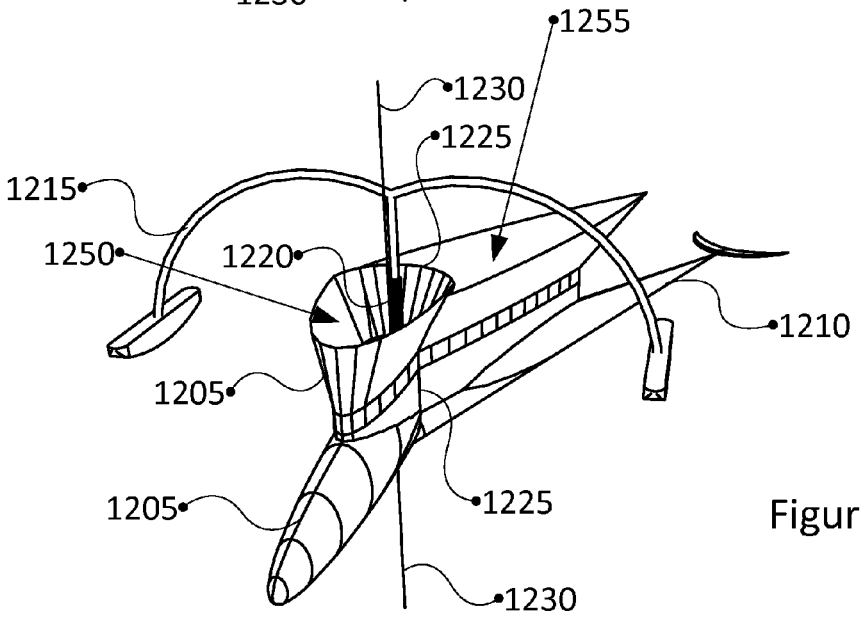
Figure 12.B

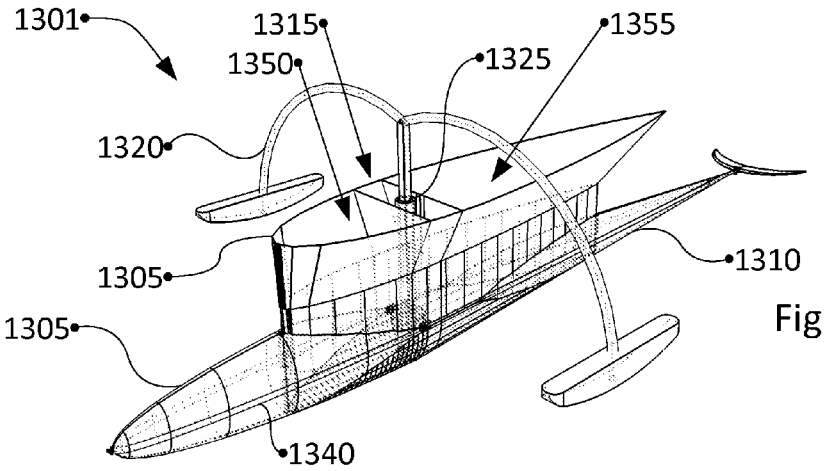
Figure 13.A
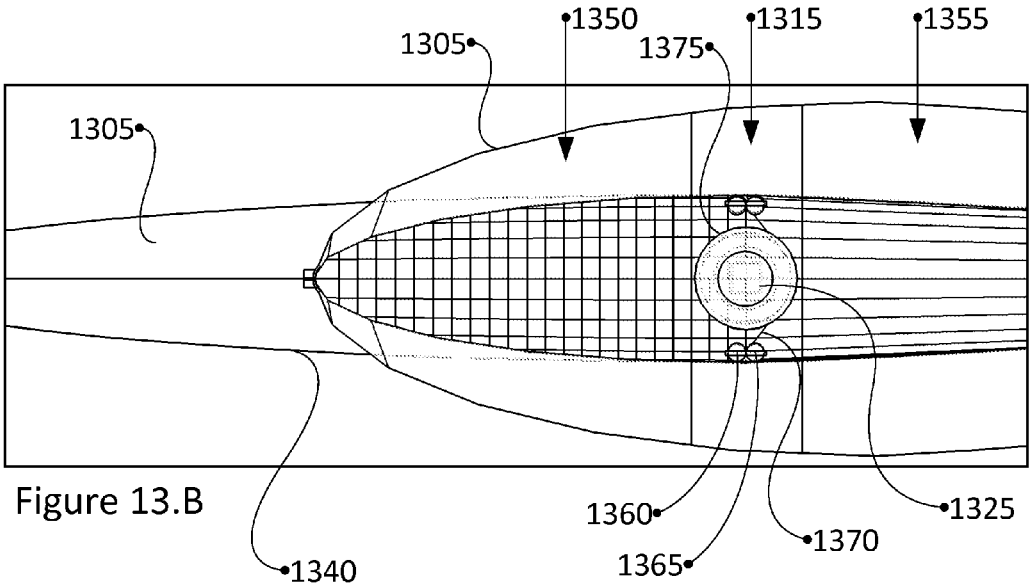
Figure 13.B

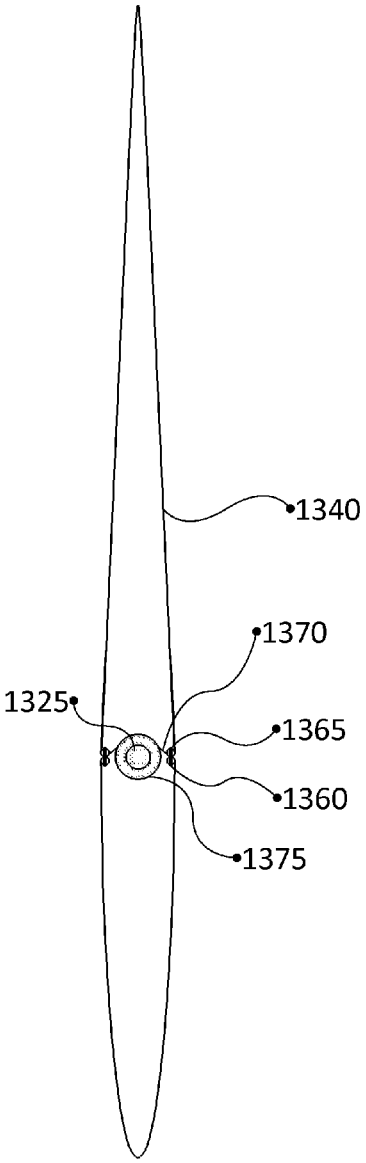
Figure 13.C
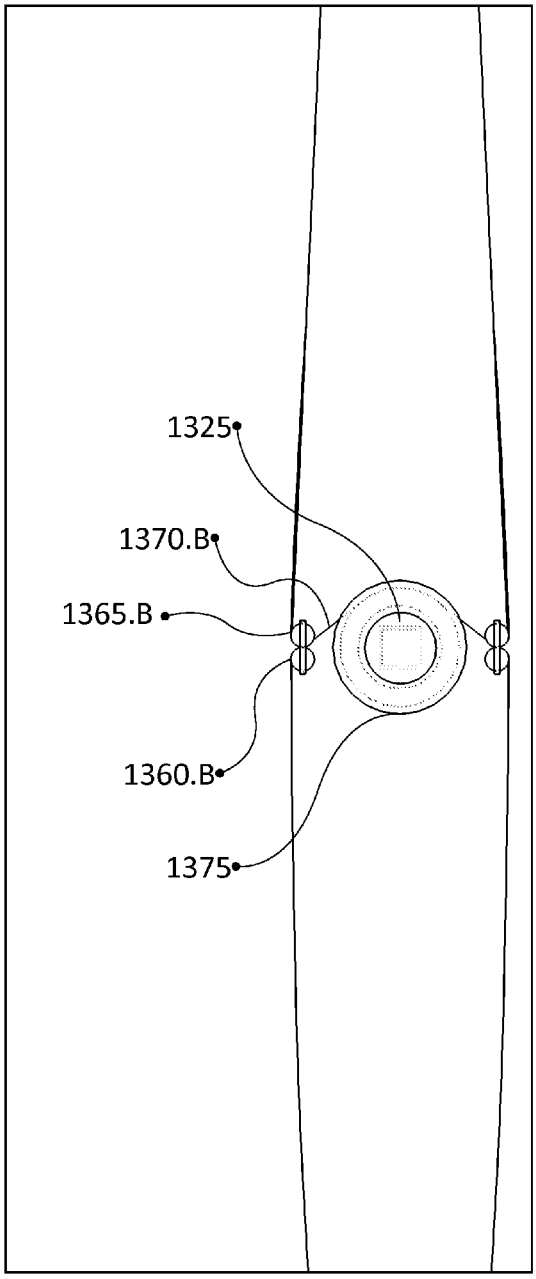
Figure 13.D

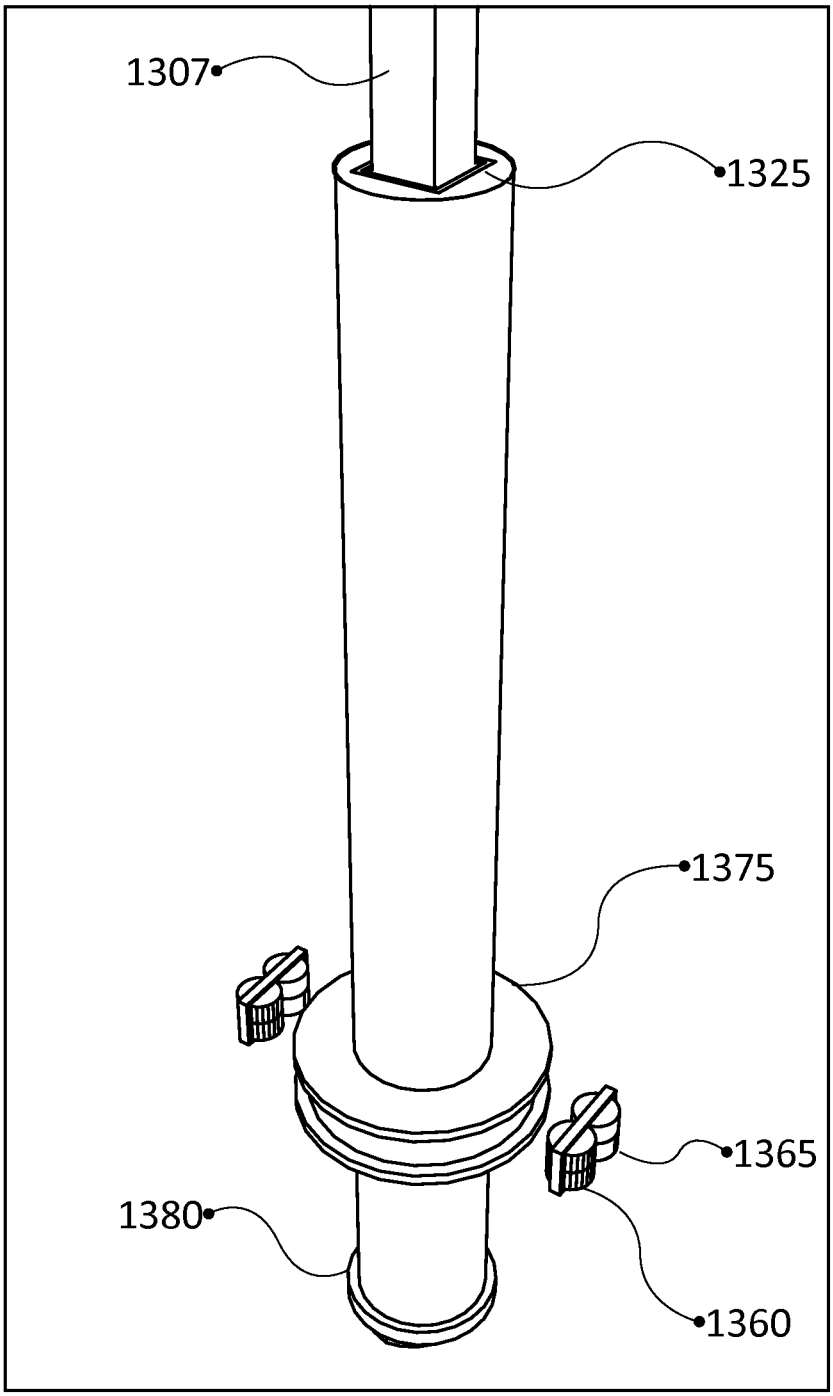
Figure 13.E

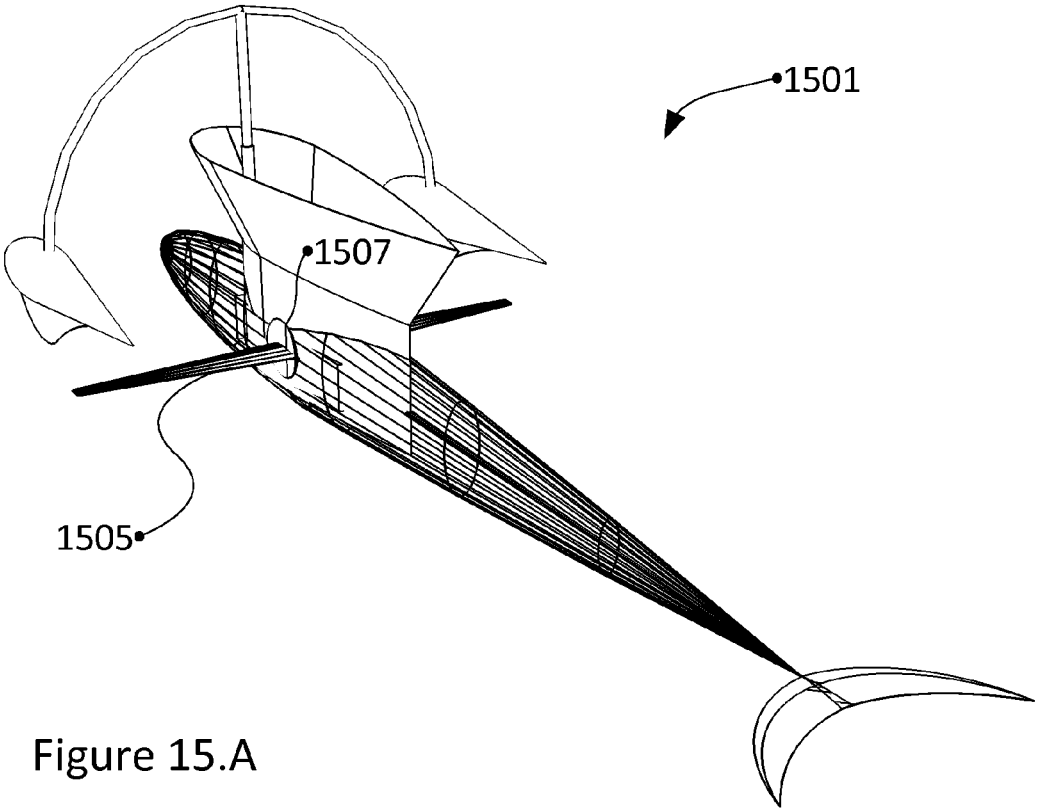
Figure 15.A

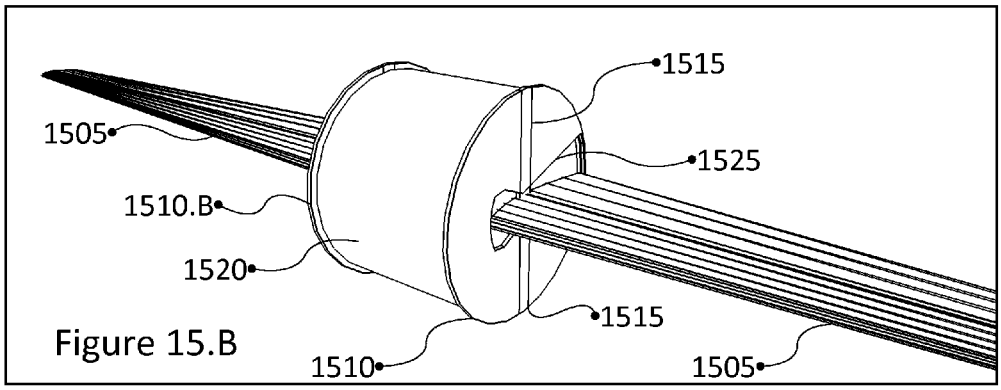
Figure 15.B
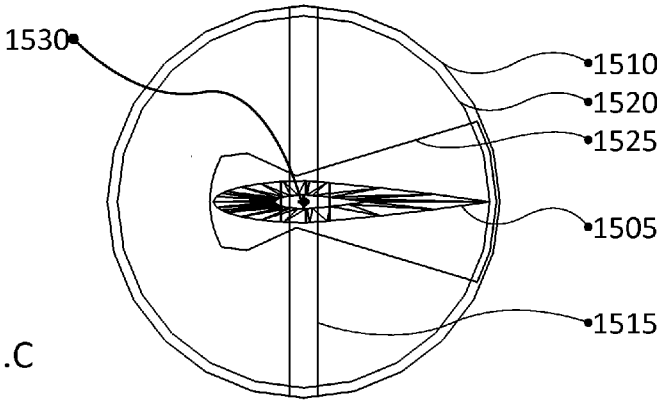
Figure 15.C
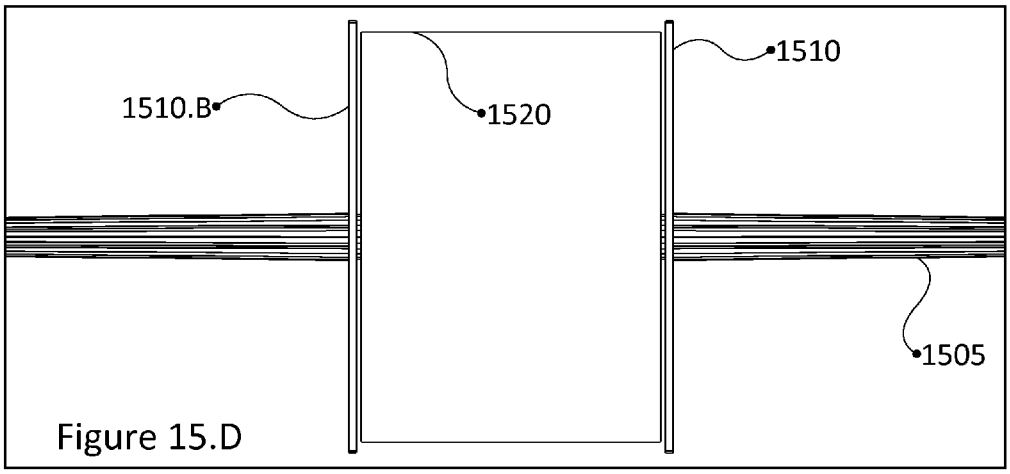
Figure 15.D

HUMAN POWERED WATERCRAFT WITH FIN PROPULSION

CROSS-REFERENCE TO RELATED APPLICATIONS

This application claims the benefit of the following U.S. patent applications, which applications are incorporated herein in their entirety, for all purposes, by this reference: Watercraft with Fin Propulsion, Ser. No. 61/799,540, filed Mar. 15, 2013, Watercraft with Fin Propulsion, Ser. No. 61/818,964, filed May 3, 2013, and Human Powered Watercraft with Fin Propulsion, Ser. No. 61/915,909, filed Dec. 13, 2013.

BACKGROUND

Watercraft are traditionally propelled by paddles, paddle wheels, propellers, impellers, and sails. Paddles are a wonderful technology for driving a thrust fluid and propelling a watercraft. While simple and versatile, paddles are relatively inefficient when compared to propellers. Among the non-sail propulsion types, propellers generally exhibit the greatest efficiency (in terms of converting input work into output thrust) at approximately 60%, though generally only if significant effort is taken to match the propeller to the boat's displacement, average speed, placement of the engine, angle of the drive-shaft, and other parameters. For most propeller driven watercraft, overall efficiency at the propeller is significantly less, on the order of 40%. In addition, the efficiency curve of a propeller generally follows the form of an inverted parabola, with peak efficiency achieved at a narrow range of speeds at the top of the efficiency curve.

In addition, design of propeller driven watercraft involves a number of well known compromises involving propeller size, placement of the engine relative to the propeller location, and hull shape, to name but a few of the issues. In addition, the thrust fluid propelled by a single propeller rotates. Rotation of the thrust fluid does not produce thrust, though is required in order to move the thrust fluid backward (which does produce thrust). Thrust fluid rotation can be eliminated or at least balanced through the use of two counter-rotating propellers, though this results in twice the propeller skin area, usually additional propeller frontal area, and (typically) twice as much drive train complexity, which reduces efficiency and decreases reliability.

Fish and marine mammals propel themselves with fins. Fins on aquatic creates exhibit greater efficiency, on the order of 80%. In addition, the efficiency curve is flatter, with very high efficiency achieved across a range of speeds, from slow to fast.

Attempts have been made to propel human-transporting watercraft with fins, though connecting the motor (be it a human or another motor) to the fins and matching the hull to the propulsion system has proven to be challenging. Connecting a motor to a fin is a complex problem, particularly in a marine environment and particularly in the context of a human power source.

BRIEF DESCRIPTION OF THE DRAWINGS

FIG. 1.A is an isometric view of an embodiment of a fishBOOT 101, Occupants 103 and 105, and Waterline 107.

FIG. 1.B is a side elevation of the fishBOOT 101 embodiment, labeling Solid Core 201, Bags 301, Straps 401, Outriggers 501, and Fluke 601.

FIG. 1.C is a top plan view of the fishBOOT 101 embodiment.

FIG. 1.D is a front elevation view of the fishBOOT 101 embodiment.

FIG. 2.A is the same isometric view of FIG. 1.A, showing Solid Core 201 and labeling components Nose Spring 203, Tail Spring 205, Spray Skirt 207, Nose Bag-Cockpit Overlap 209, Nose Skirt-Cockpit Overlap 210, Tail Bag-Cockpit Overlap 211, Cockpit 213, Outrigger Guide 215, and Tail Spring Fluke Tube 221.

FIG. 2.B is the same side elevation view as FIG. 1.B, labeling Solid Core 201 components.

FIG. 2.C is the same top plan view as FIG. 1.C, labeling Solid Core 201 components.

FIG. 2.D is the same front elevation view as in FIG. 1.D, labeling Solid Core 201 components.

FIG. 2.E is a rear elevation view of Solid Core 201 components.

FIG. 2.F is a close top plan view of components of Solid Core 201 and additionally labeling Port Cockpit-Nose Spring Brace 217 and Starboard Cockpit-Nose Spring Brace 218.

FIG. 2.G is a close view of Solid Core 201 components, in perspective from the rear and above.

FIG. 2.H is a close side elevation view of forward Solid Core 201 components.

FIG. 2.I is a close side elevation view of aft Solid Core 201 components, additionally labeling Cockpit-Tail Spring Brace 219 and Tail Spring Fluke Tube 221.

FIG. 2.J is a close top plan view of a Cockpit-Tail Spring Brace 219 between the Cockpit 213 and the Tail Spring 205.

FIG. 2.K is a close forward perspective view of a Fluke Clasp 223, which impinges on Tail Spring Fluke Tube 221.

FIG. 3.A is the same isometric view of FIG. 1.A showing Bag 301 and labeling components Port Tail Bag 303, Starboard Tail Bag 311, Port Nose-Tail Bag Connector 307, Starboard Nose-Tail Bag Connector 309, Nose Skirt 310, Port Nose Bag 305, and Starboard Nose Bag 313.

FIG. 3.B is the same side elevation view as in FIG. 1.B, labeling Bag 301 components.

FIG. 3.C is the same top plan view as in FIG. 1.C, labeling Bag 301 components.

FIG. 3.D is the same front elevation view as in FIG. 1.D, labeling Bag 301 components.

FIG. 3.E is a rear elevation view of Bag 301 components.

FIG. 3.F is a top plan view Port Tail Bag 303 and Port Nose Bag 305.

FIG. 4 is the same isometric view of FIG. 1.A showing and labeling Strap 401.

FIG. 7.A illustrates fishBOOT 101 and Outrigger 501 in a low position.

FIG. 7.B illustrates fishBOOT 101 and Outrigger 501 in a high position.

FIG. 9.A is an isometric view of fishBOOT 901 and Nose 910, Steering Column 915, Center Pole 920, Cockpit 925, Cockpit Hinge Bracket 930, Nose Hinge Bracket 935, and Spray Skirt 940.

FIG. 9.B is a bottom plan view of fishBOOT 901 and components.

FIG. 9.C is a close perspective view of Steering Column 915, Center Pole Key 917, Center Pole 920, and Spray Skirt 940.

FIG. 10.A is the isometric view of FIG. 9.A, illustrating the fishBOOT 901 while turning.

FIG. 10.B is the bottom plan view of FIG. 9.B, illustrating the fishBOOT 901 while turning to the same extent as in FIG. 10.A.

FIG. 10.C is the close perspective view of FIG. 9.C, illustrating the fishBOOT 901 while turning to the same extent as in FIG. 10.A.

FIG. 11.A is an isometric view of fishBOOT 1101, with Fore Cockpit Cell 1150 and Aft Cockpit Cell 1155, Outrigger 1115, Starboard Center Pole 1120, Port Center Pole 1125, Aft Cell Face 1130, Tail 1110, and Hinge 1135.

FIG. 11.B is the same isometric view of FIG. 11.A, illustrating the fishBOOT 1101 while turning.

FIG. 12.A is an isometric view of fishBOOT 1201, with Fore Cockpit Cell 1250 and Aft Cockpit Cell 1255, Outrigger 1215, Center Pole Assembly 1220, Cell-Cell Interface 1225, Tail 1210, and Nose 1205.

FIG. 12.B is the same isometric view of FIG. 12.A, illustrating the fishBOOT 1201 while turning.

FIG. 13.A is an isometric view of fishBOOT 1301, with Fore Cockpit Cell 1350 and Aft Cockpit Cell 1355, Water Isolation Cell 1315, Outrigger 1320, Center Pole Assembly 1325, Straps 1340, Tail 1310, and Nose 1305.

FIG. 13.B is a top plan view of fishBOOT 1301, further labeling Fore Roller 1360, Aft Roller 1365, Wheel-Strap Span 1370, and Wheel 1375.

FIG. 13.C is a top plan view of Straps 1340 and other turning components.

FIG. 13.D is a close top plan view of a portion of FIG. 13.C.

FIG. 13.E is a perspective view of Center Pole Assembly 1325, Wheel 1375, Fore Strap Roller 1360, Aft Strap Roller 1365, and Pole Bearing 1380.

FIG. 15.A is a rear perspective view of fishBOOT 1501, labeling Forward Wing 1505 and Cockpit Wing Tube 1507.

FIG. 15.B is a front perspective view of Forward Wing 1505, Bracket 1510, Bar 1515, Block 1520, and Cut-Out 1525.

FIG. 15.C is a side elevation view of the components illustrated in FIG. 15.B, further labeling Wing Rod 1530.

FIG. 15.D is a front elevation detail view of Forward Wing 1505, Bracket 1510, and Block 1520.

DETAILED DESCRIPTION

Figure 5:
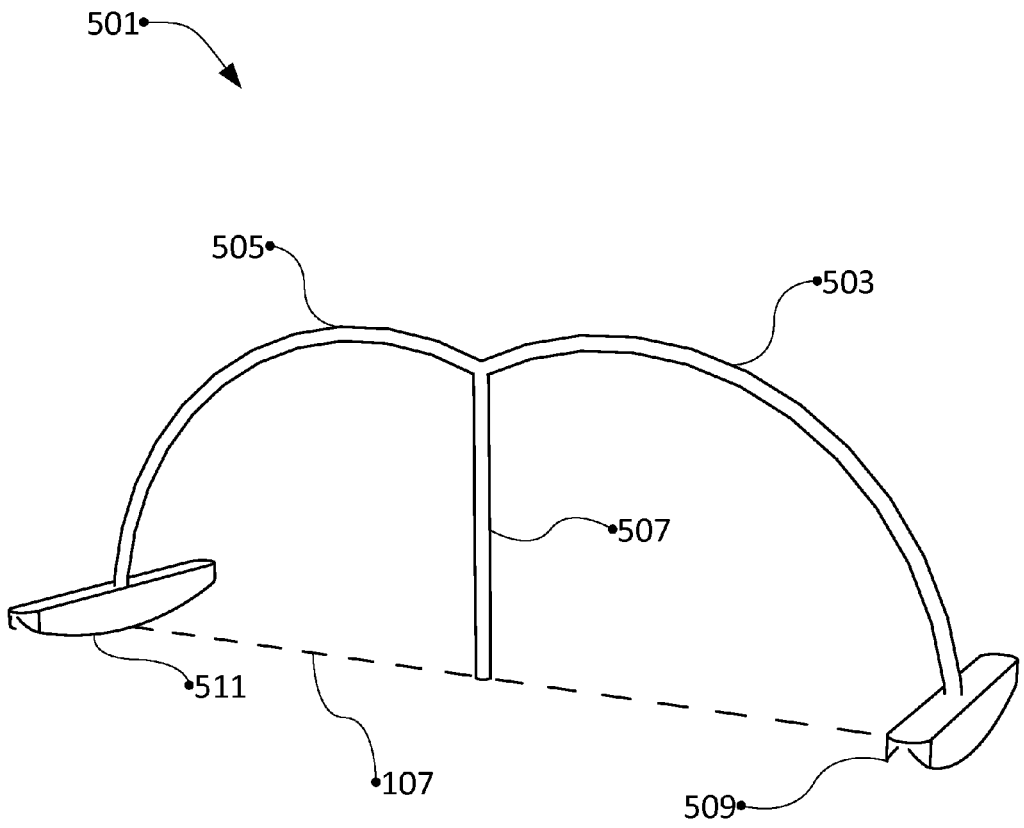
FIG. 5 is the same isometric view of FIG. 1.A showing Outrigger 501 and labeling Port Arm 503, Starboard Arm 505, Center Pole 507, Port Ama 509, Starboard Ama 511, and Waterline 107.
Figure 6:
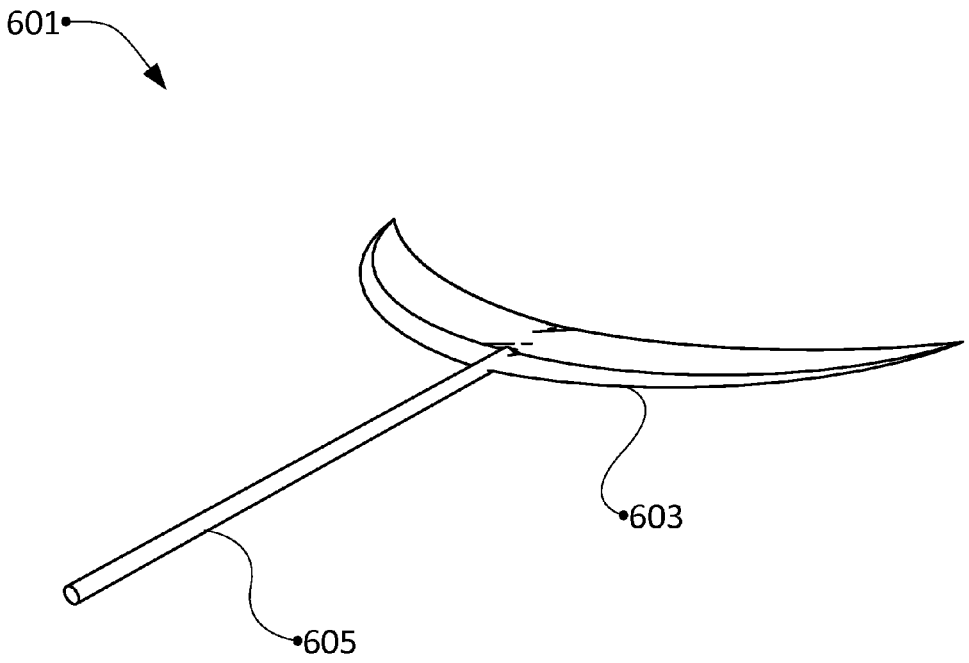
FIG. 6 is an isometric view of Fluke 601, labeling Flap 603 and Fluke Arm 605.

As used herein, "releasable," "connect," "connected," "connectable," "disconnect," "disconnected," and "disconnectable" refers to two or more structures which may be connected or disconnected, generally without the use of tools (examples of tools including screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

FIG. 1.A through 1.D illustrate a fishBOOT 101 embodiment, comprising the Solid Core 201, Bags 301, Straps 401, Outrigger 501, and Fluke 601. The Solid Core and Bags, together, may also be referred to herein as a "displacement body."

The fishBOOT 101 embodiment is approximately 12' 6" long by 9" wide by approximately 28" high, from the bottom of the Solid Core 201, to the top of the Spray Skirt 207. It is approximately 14" from the bottom of the Solid Core to the Waterline 107. The total displacement of the fishBOOT 101, including Occupants, results in the Waterline 107. The displacement can be adjusted to accommodate Occupants of different weights by changing the displacement of Bags 301. An air pump may be provided in the Cockpit, such as Cockpit 213, to provide air for the Bags 301. The port and starboard Bags as well as the fore and aft Bags may be connected via tubes to allow air from a compressed Bag to flow into the other, uncompressed Bag, such as during a turn or to allow air and displacement to be varied, between fore and aft. Valves may be provided to pump air into or evacuate air from the Bags. The Bags and air pump may be used to provide a steering force (discussed further below).

The Occupants adjust the normal trim of the fishBOOT by moving toward and away from the center of displacement. In these drawings, the center of displacement of the fishBOOT is one-third of the distance from the tip of the Nose to the Tail; there is equal displacement fore and aft of the center of displacement. The aft edge of Nose Skirt 310 and the vertically oriented central axis of the Outrigger in FIG. 13.A are at the center of displacement. A different shape may produce a different location of the center of displacement. The illustrated shape is generally based on a NACA wing profile.

The Occupants may bend their knees in a 90 degree phase (when one Occupant is going up, the other is going down) to produce cyclic pitching of the fishBOOT about the central transverse axis and thrust.

The Occupants may step or otherwise shift their weight toward and away from the central transverse axis in a 90 degree phase (when one is coming in toward the center, the other is going out), to produce cyclic pitching of the fishBOOT about the central transverse axis.

Cyclic pitching of the fishBOOT about the central transverse axis results in heaving Fluke 601 up and down. The Occupants may move with a technique to produce a sinusoidal wave form in the heave of Fluke 601 as the fishBOOT passes through the water.

The Fluke Arm 605 secures the Fluke 601 to the Tail Spring 205, with the Fluke Arm 605 secured within Fluke Tube 221 by Fluke Clasp 223. The Fluke Arm 605 is flexible, so that as the Fluke 601 is heaved, the Flap 603 maintains an appropriate angle of attack (approximately 25 degrees, on either side of normal) to displace maximum thrust fluid and develop maximum thrust. The length of Fluke Arm 605 extending out of Fluke Tube 221 is variable, through use of Fluke Clasp 223. A bolt or the like within Fluke Clasp 223 may be loosened to allow Fluke Arm 605 to slide fore and aft within Tail Spring Fluke Tube 221 and then tightened to prevent Fluke Arm 605 from moving, relative to Tail Spring 205. Varying the length of Fluke Arm 605 extending out of Fluke Tube 221 allows the stiffness of the Fluke Arm 605 and the deflection of the Fluke 601 to be varied. The distance between the Tail Spring and Fluke may be matched to the modulus of flexibility of the Fluke Arm 605 and the desired deflection of the Fluke 601. The Fluke Clasp 223 may impinge on the interior of the Fluke Tube 221 and may be used to secure the Fluke Arm 605 at a distance between the Tail Spring 205 and Fluke 601. Connection of the Flap 603 to the Fluke Arm 605 may be fixed or may be via a join, similar to the join illustrated and described in relation to Forward Wing 1505, Wing Rod 1530, and Bars 1515, which provides a prescribed amount of deflection. The Flap 603 and/or Fluke Arm 605 may be made of fiberglass, carbon fiber, or another flexible material optionally with a membrane of rubber or silicone rubber.

The vertical attitude of the fishBOOT is maintained by the Outrigger 501. The Outrigger floats separately from the fishBOOT. The Central Outrigger Pole 507 and is free to rise up and down within the Outrigger Guide 215. One or another of the Occupants can push down on the Outrigger to increase the righting force offered by the Outrigger 501. The Outrigger 501 can be released, allowing it to rise, decreasing the righting force and decreasing the resistance created by the Amas 503 and 505 passing on or through the water. The separately floating Outrigger and variable righting force allows the fishBOOT Occupants to continuously and intuitively balance righting force and Ama drag as conditions and circumstance dictate.

The Solid Core 201 comprises a hollow Cockpit 213 made of fiberglass, carbon fiber, aramids, plastic, wood, composites thereof, ceramics, metals or another generally rigid material. The Solid Core 201 as illustrated is designed to accommodate two occupants, 103 and 105, standing inside of it, generally as illustrated in FIG. 1.A (the Occupants in FIG. 1.A, are 5' 9" tall). Two Occupants are illustrated in FIG. 1.A, though more or fewer may be accommodated by other embodiments. For example, the embodiment in FIG. 15 is sized to accommodate one Occupant.

The Solid Core 201 comprises Spray Skirt 207, which protects the Occupants from spray and splashes. The Occupants may wear a fabric spray skirt which may span from the waste or shoulders of the Occupants to the Spray Skirt 207.

The Solid Core 201 comprises Outrigger Guide 215, through which Center Pole 507 of Outrigger 501 may pass, allowing Outrigger 501 to float separately from the fishBOOT. An alternative (not shown) is to place the Outriggers on (optionally spring-loaded) lever arms attached to the ends of a rod spanning a central outrigger pole. In this case, the occupant may rotate the lever arms about the transverse axis of the rod spanning the central outrigger pole to apply a variable pressure on the amas. In this case, the central outrigger pole may or may not float (it may have a fixed elevation), though it may still rotate about its vertical axis.

The Solid Core 201 comprises Nose Spring 203 and Tail Spring 205. The Nose and Tail Springs may also be referred to herein as "projections" and as "segments." The Nose and Tail Springs are generally flat, vertically oriented sheets of fiberglass, carbon fiber, aramid, wood or the like. The Nose Spring 203 may be secured to the fore of the Cockpit 213 at the Cockpit-Nose Spring Braces 217 and 218 while the Tail Spring 205 may be secured to the aft of the Cockpit at the Cockpit-Tail Spring Brace 219. The Cockpit Spring Braces may comprise hinges or may be a fixed connection or attachment.

Figure 14:
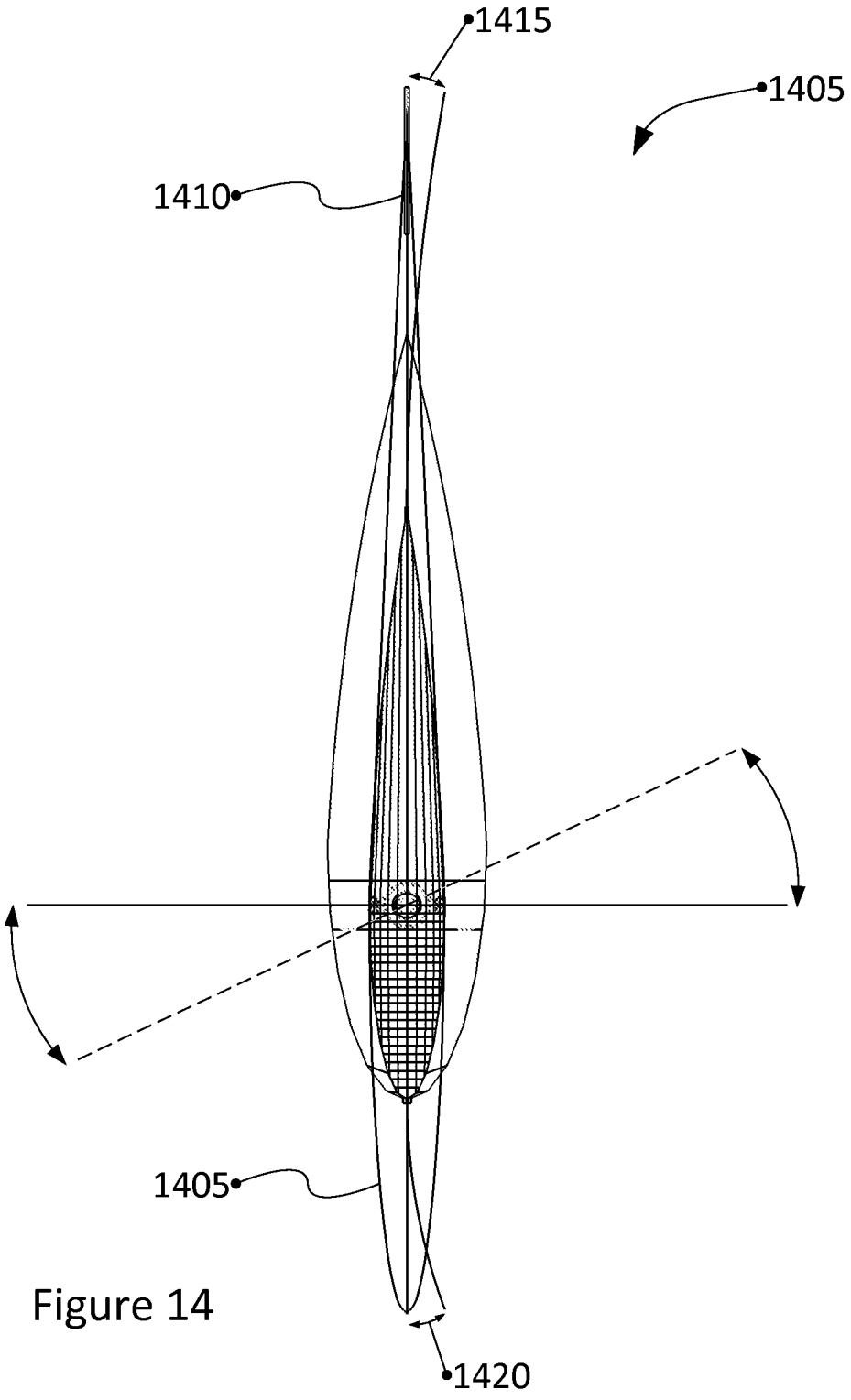
FIG. 14 is a top plan view of fishBOOT 1405, illustrating bending of the Nose 1405 and Tail 1410 during a turn.
Figure 16:
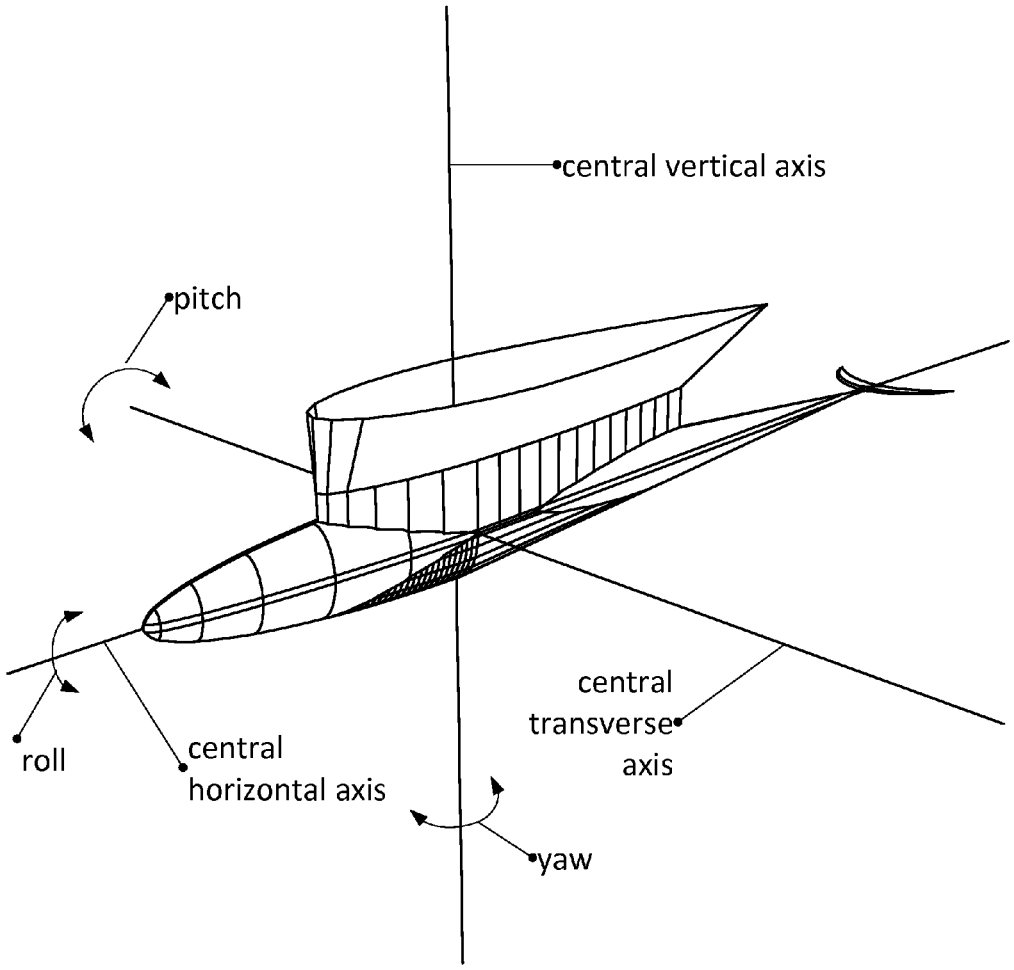
FIG. 16 is an isometric illustration of a fishBOOT embodiment and the central vertical axis about which yaw occurs, the central horizontal axis about which roll occurs, and the central transverse axis about which pitch occurs.

The Nose and Tail Springs may be flexible. The flexible Springs may be deflected, such as at the tips, by a steering force. Components to provide a steering force via the Straps 1340 are illustrated in FIGS. 13.A through 13.E. Deflection of the Nose and Tail Spring is illustrated in FIG. 14. The flexible Springs may have a bias to return to a normal straight position.

Some or all of the Nose and Tail Springs may be rigid and may be attached to the Cockpit 213 or an interstitial location at hinges with a vertically oriented axis, which hinges allow the Springs to rotate about the hinges, providing a steering force. Such hinges may be spring-loaded, to bias the Spring to return to the normal straight position. Examples of hinged embodiments are illustrated and discussed in relation to FIGS. 9.A through 12.B.

One or both Nose and Tail Springs may be removable from the Cockpit. Larger or smaller Nose or Tail Springs and larger or smaller Bags may used, for example, to change the displacement of the craft.

Figure 8:
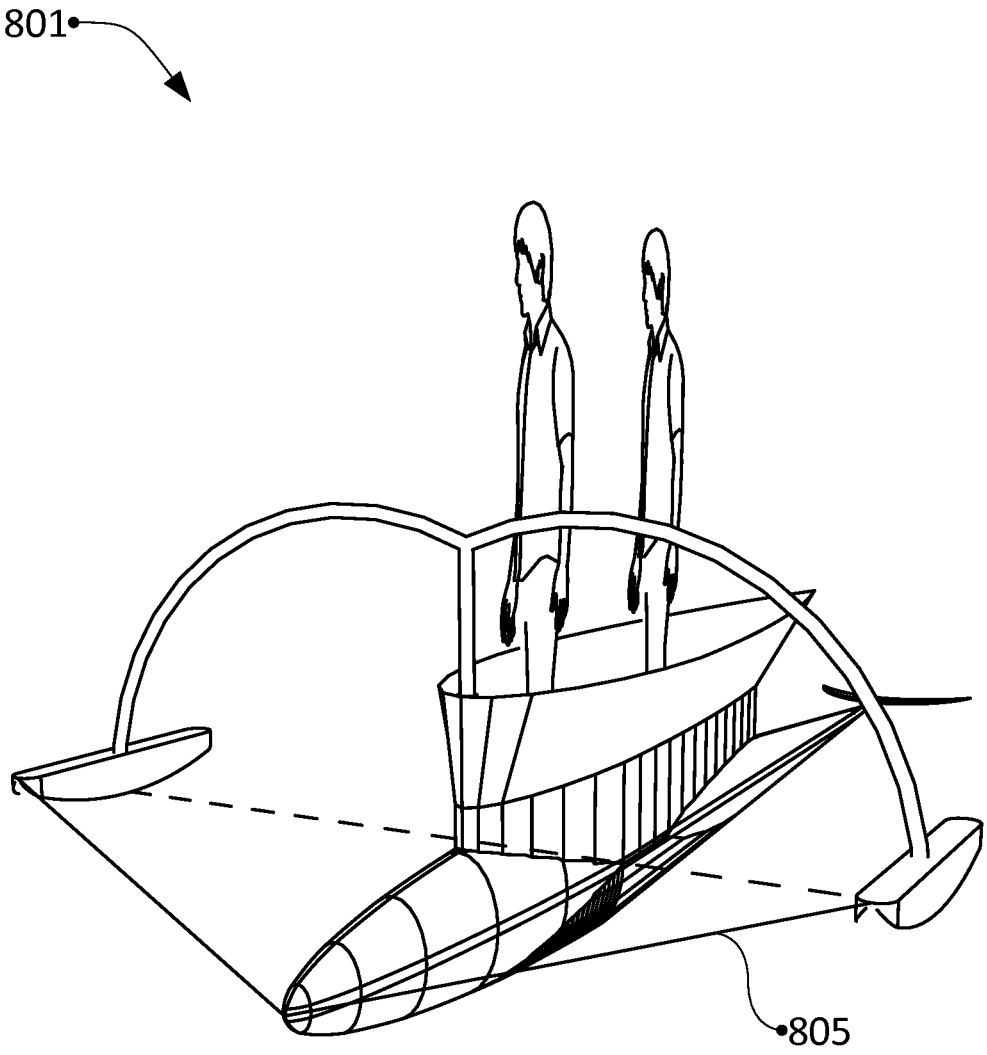
FIG. 8 illustrates fishBOOT 801 and Steering Lines 805.

The steering force may be supplied by lines attached to Outrigger 501, as illustrated by Steering Lines 805 (FIG. 8). In FIG. 8, the Steering Lines 805 may connect the Outrigger to a Nose or Tail, which Nose or Tail may be attached to the Cockpit via a spring or a hinge. The steering force may be supplied by rotation of the Outrigger, generally about the central vertical axis of the Outrigger, with work generally provided by an Occupant. The steering force may be communicated by the Straps 401, discussed further in relation to FIGS. 13 and 14. The steering force may be supplied from one portion of the fishBOOT to the other, such as from the aft to the fore, as in the hinged embodiments discussed in relation to FIGS. 9 through 12, or from the port to the starboard (or visa versa), as in the embodiment discussed in relation to FIGS. 13 and 14.

The Bags 301 or a section or tube(s) within the Bags may be inflated to match the displacement of the craft to the weight of the craft and riders and a desired waterline. The Bags 301 may comprise close fitting nested sleeves or socks which may be pulled onto or removed from the Nose or Tail to increase or decrease displacement. A cone such as a nose cone may protect the Nose Bag from abrasion by the Steering Strings. The Nose Cone may extend toward the center of displacement. The Nose Cone may comprise the most forward ringed portion of fishBOOT 101. The port and starboard Bags may be connected by fabric, including through the use of fasteners, such as zippers, ties, snaps, buttons, and the like. The connecting fabric may be secured to the Nose Skirt 310. The connecting fabric may span the bottom margin of adjacent port-starboard Bags, in which case the Spring above the connecting fabric serves to hold the bags down in the water. Connecting fabric may span from the fore Bags to the aft Bags, along the bottom of the craft.

FIG. 3.F illustrates Port Nose Bag 305, Port Tail Bag 303, and Port Nose-Tail Bag Securement 307. Similar components may be provided for the starboard side. As noted, connecting fabric may span the bottom margin of two adjacent port-starboard Bags.

The Bags may be air bags comprising plastic, nylon, denier, woven and non-woven fabrics, neoprene and similar materials. The Bags may also be a foam, such as a closed-cell foam. The Bags may contain within them one or more chambers which may be inflated or deflated to change the displacement of the Bags and/or to provide a steering force. The Bags may be designed to compress to tolerate bending of the Nose or Tail. The Bags may be sheathed beneath one or more surface shells, which shells may overlap, similar to a fish scale.

FIG. 4 is the same isometric view of FIG. 1.A showing and labeling Strap 401. Strap 401 may assist in retaining the Bags and may communicate a steering force. An embodiment which utilizes Straps to communicate a steering force is illustrated in FIGS. 13 and 14.

FIG. 5 is the same isometric view of FIG. 1.A showing Outrigger 501 and labeling Port Arm 503, Starboard Arm 505, Center Pole 507, Port Ama 509, Starboard Ama 511, and Waterline 107. The Arms and Center Pole 507 may be plastic, fiberglass, carbon fiber, aramid, metal or another like material. The Amas may comprise foam, an air bag, or a hollow structure. The bottom of the Amas, which contacts the water, may be curved (as illustrated) to allow the Amas to rock forward and backward, with the pitching of the craft, while maintaining generally the same contact with the water.

FIG. 9.A is an isometric view of fishBOOT 901 and Nose 910, Steering Column 915, Center Pole 920, Cockpit 925, Cockpit Hinge Bracket 930, Nose Hinge Bracket 935, Spray Skirt 940, and Spray Skirt Cuff 918. Cockpit Hinge Bracket 930 may be attached to Cockpit 925; Nose Hinge Bracket 935 may be attached to Nose 910. Steering Column 915 may be attached to Nose Hinge Bracket 935 and may be seated in a retaining bearing in Cockpit Hinge Bracket 930 and Spray Skirt Cuff 918, which bearings allow the Steering Column (and Nose, attached to Steering Column at Nose Hinge Bracket) to rotate.

FIG. 9.B is a bottom plan view of fishBOOT 901 and components.

FIG. 9.C is a close perspective view of Steering Column 915, Center Pole Key 917, Spray Skirt Cuff 918, Rectangular Center Pole 920, and Spray Skirt 940. Outrigger 905 is free to float, up and down, within Steering Column 915. Center Pole Key 917 is attached to or a part of the Steering Column 915, but is not attached to Center Pole 920. Center Pole Key 917 may extend or be repeated down into Steering Column 915. Because Center Pole Key 917 and Center Pole 920 do not have a circular horizontal cross-section, rotation of the Outrigger 905 and the Center Pole 920 about the central vertical axis of Center Pole 920 results in a rotational force on the Steering Column 915 which produces a steering force.

FIG. 10.A is the isometric view of FIG. 9.A, illustrating the fishBOOT 901 while turning.

FIG. 10.B is the bottom plan view of FIG. 9.B, illustrating the fishBOOT 901 while turning to the same extent as in FIG. 10.A.

FIG. 10.C is the close perspective view of FIG. 9.C, illustrating the fishBOOT 901 while turning to the same extent as in FIG. 10.A.

FishBOOT 901 is hinged. Nose 910 may be separate from Cockpit 925. Nose Hinge Bracket 935 may be attached to Nose 910, while Cockpit Hinge Bracket 930 may be attached to Cockpit 925. Steering Column 915 may be attached to Nose Hinge Bracket 935 and may pass through the interior of Cockpit Hinge Bracket 930; a bearing may be provided between the Steering Column 915 and the Cockpit Hinge Bracket 930. A ring bearing or the like may be provided at the top of Spray Skirt 940, such as at Spray Skirt Cuff 918, to secure the top of Steering Column 915 to the Spray Skirt 940 while allowing the Steering Column 915 to rotate about its central vertical axis. Other embodiments of a hinge may be provided. A thin rubber sheet or skin (not shown) may extend from the Nose aft, overlapping with the Hinge Brackets and the Cockpit 925, smoothing the water flow between these components.

FIG. 11.A is an isometric view of fishBOOT 1101, with Fore Cockpit Cell 1150 and Aft Cockpit Cell 1155, Outrigger 1115, Starboard Center Pole 1120, Port Center Pole 1125, Aft Cell Face 1130, Tail 1110, and Hinge 1135.

FIG. 11.B is the same isometric view of FIG. 11.A, illustrating the fishBOOT 1101 while turning.

FishBOOT 1101 may accommodate two Occupants, one in the Fore Cockpit Cell 1150 and another in the Aft Cockpit Cell 1155. To produce a steering force, the aft Occupant may rotate the Outrigger 1115 about the central vertical axis of the Outrigger 1115. As discussed elsewhere herein, the Outrigger 1115 may float separately from fishBOOT 1101. A rubber sheet may be bonded to the trailing edge of the Fore Cockpit Cell 1150, to smooth the flow of water to the Aft Cockpit Cell 1155.

FIG. 12.A is an isometric view of fishBOOT 1201, with Fore Cockpit Cell 1250 and Aft Cockpit Cell 1255, Outrigger 1215, Center Pole Assembly 1220, Cell-Cell Interface 1225, Tail 1210, and Nose 1205.

FIG. 12.B is the same isometric view of FIG. 12.A, illustrating the fishBOOT 1201 while turning.

A hinge (similar to the other hinges discussed herein) may be provided between the Fore Cockpit Cell 1250 and the Aft Cockpit Cell 1255, securing the Fore and Aft Cockpit Cells and allowing them to turn along the central vertical axis of the hinge, labeled at element 1230. The Center Pole Assembly 1220 may be similar to Steering Column 915, Center Pole Key 917, Rectangular Center Pole 920, discussed above, allowing the Outrigger 1215 to float separately from the fishBOOT 1201, while also producing a steering force equivalent to the steering force produce with Steering Column 915. The Fore and Aft Cockpit Cells may have a space between them at the Cell-Cell Interface 1225. A rubber sheet may be bonded to the trailing edge of the Fore Cockpit Cell 1250, to smooth the flow of water to the Aft Cockpit Cell 1255, across the Cell-Cell Interface 1225.

The hinged embodiments may be spring loaded, biasing the portions to return to the straight orientation. Portions on either side of a hinge may also be referred to herein as "segments."

FIG. 13.A is an isometric view of fishBOOT 1301, with Fore Cockpit Cell 1350 and Aft Cockpit Cell 1355, Water Isolation Cell 1315, Outrigger 1320, Center Pole Assembly 1325, Straps 1340, Tail 1310, and Nose 1305.

FIG. 13.B is a top plan view of fishBOOT 1301, further labeling Fore Roller 1360, Aft Roller 1365, Wheel-Strap Span 1370, and Wheel 1375.

FIG. 13.C is a top plan view of Straps 1340 and other turning components.

FIG. 13.D is a close top plan view of a portion of FIG. 13.C.

FIG. 13.E is an isometric view of Center Pole Assembly 1325, Wheel 1375, Fore Strap Roller 1360, Aft Strap Roller 1365, and Pole Bearing 1380. The Pole Bearing 1380 may be a bearing between the base of the Water Isolation Cell 1315 and the Center Pole Assembly 1325.

Water Isolation Cell 1315 may isolate water which may enter the Water Isolation Cell 1315 from the Fore and Aft Cockpit Cells. Water Isolation Cell 1315 is illustrated as having flat walls; in another embodiment, the walls of Water Isolation Cell 1315 may conform more closely to the Center Pole Assembly 1325, Wheel 1375, Fore Strap Roller 1360, Aft Strap Roller 1365, and Pole Bearing 1380. Water may enter the Water Isolation Cell 1315 in the location of Fore and Aft Rollers.

The Straps 1340 may enter the Water Isolation Cell 1315 at the Fore and Aft Rollers. The Straps 1340 may contact the Wheel 1375. Grommets or similar may be provided in the Straps with a corresponding structure in the Wheel 1375 (such as teeth) to ensure energy transfer between the Wheel 1375 and the Straps 1340 as the Wheel 1375 rotates.

The aft Occupant in the Aft Cockpit Cell 1355 may turn Outrigger 1320, which via Center Pole Assembly 1325, may turn the Wheel 1375, which may pull the Strap 1340 from one side of fishBOOT 1301 to the other. The Strap 1340 on the side being shortened pulls the Nose 1305 and/or Tail 1310 in toward the Cockpits, while the Strap 1340 lengthens on the other side. FIG. 14 is a top plan view of fishBOOT 1405, illustrating bending of the Nose 1405 and Tail 1410 during a turn.

FIG. 15.A is a rear isometric view of fishBOOT 1501, labeling Forward Wing 1505 and Cockpit Wing Tube 1507.

FIG. 15.B is a front isometric view of Forward Wing 1505, Bracket 1510, Bar 1515, Block 1520, and Cut-Out 1525.

FIG. 15.C is a side elevation view of the components illustrated in FIG. 15.B, further labeling Wing Rod 1530.

FIG. 15.D is a front elevation detail view of Forward Wing 1505, Bracket 1510, and Block 1520.

FIG. 15.A through 15.D illustrate a fishBOOT 1501 with a Forward Wing 1505. The Forward Wing 1505 passes through the Cockpit within Cockpit Wing Tube 1507. Brackets 1510 contact the interior of Cockpit Wing Tube 1507. Bars 1515 go through the Forward Wing 1505 at approximately the center of displacement (generally the one-third point from the leading edge); Wing Rod 1530 passes through a hole in the Bars 1515. Forward Wing 1505 is free to rotate approximately +/−25 degrees about Wing Rod 1530.

Cut-Outs 1525 allow Forward Wing 1505 to rotate within the Bracket 1510. Forward Wing 1505 has Block 1520 attached to it. Block 1520 does not contact the Cockpit Wing Tube 1507 nor the Brackets 1510. Block 1520 reduces the amount of water flowing through the Cockpit Wing Tube 1507 and reduces turbulence. A fairing may be added to the exterior of Brackets 1510 to make the surface of the Brackets 1510 flush with the surface of the hull. A thin fairing may be added to the exterior surface of Forward Wing 1505 and/or hairs may be added to Bracket 1510 (or in the fairing on the exterior of Brackets 1510), to further reduce turbulence.

The connection between Forward Wing 1505, Wing Rod 1530, and Bars 1515 may be spring-loaded, such that rotation of Forward Wing 1505 about the Wing Rod 1530 meets increasing resistance and biases the Forward Wing 1505 to return to a horizontal orientation. Spring-loading may be provided by, for example, a set of springs, leaf springs, a coil spring, rubber bands, or the like. The spring(s) may be connected to or contact Forward Wing 1505 and may be connected to or contact the Bracket 1510, Cockpit Wing Tube 1507, Bar 1515, and/or Wing Rod 1530. The spring(s) may be adjustable, to provide a variable amount of resistance. The spring(s) may be incorporated into a cassette, which cassette is centered around the pivotal junction between the wing 006 and the bar 016 (such as around the rod 018).

The orientation, posture, and other details of the Occupants in the illustrations are artifacts of the program used to prepare the drawings. The Occupants are illustrated to provide a basic human scale.

The invention claimed is:

1. A watercraft comprising:

a displacement body comprising a vertically oriented outrigger guide tube, an outrigger comprising a vertically oriented pole, and a fluke;

wherein the outrigger floats separately from the watercraft, the vertically oriented pole is within the vertically oriented outrigger guide tube, and the vertically oriented pole is free to slide up and down within the vertically oriented outrigger guide tube.

2. The watercraft according to claim 1, wherein the displacement body further comprises a cockpit within which a human occupant may be located.

3. The watercraft according to claim 1, wherein the vertically oriented outrigger pole has a non-circular horizontal cross-section which fits within a corresponding opening in the vertically oriented outrigger guide tube.

4. The watercraft according to claim 3, wherein the vertically oriented outrigger guide tube may be rotated about either its vertical axis or the vertical axis of a hinge.

5. The watercraft according to claim 4, wherein the displacement body comprises a deflectable projection, wherein the vertically oriented outrigger guide tube may be rotated about its vertical axis, wherein the vertically oriented outrigger guide tube communicates a steering force to a strap, wherein the strap communicates the steering force to the deflectable projection.

6. The watercraft according to claim 1, wherein the watercraft comprises a first and a second segment, which segments are attached by a hinge and wherein the vertically oriented outrigger guide tube is attached to the first segment.

7. The watercraft according to claim 2, wherein the displacement body further comprises projections fore and aft of the cockpit, which projections comprise a nose and a tail, which tail is secured to the fluke.

8. The watercraft according to claim 7, wherein the outrigger communicates a steering force to at least one of the projections.

9. The watercraft according to claim 7, wherein at least one of the projections is secured to the cockpit by a hinge with a vertical axis.

10. The watercraft according to claim 9, wherein a steering force causes rotation of the projection around the hinge vertical axis.

11. The watercraft according to claim 7, wherein at least one of the projections is fixed to the cockpit.

12. The watercraft according to claim 11, wherein a steering force causes bending of at least one of the projections.

13. The watercraft according to claim 7, wherein the displacement body further comprises a first bag with adjustable displacement.

14. The watercraft according to claim 13, wherein the displacement body further comprises a second bag with adjustable displacement.

15. The watercraft according to claim 14, wherein the first and second bags are on either side of at least one of the projections.

16. The watercraft according to claim 2, wherein the displacement body comprises a forward cockpit and an aft cockpit.

17. The watercraft according to claim 16, wherein the outrigger communicates a steering force to a projection extending off of at least one of the cockpits.

18. The watercraft according to claim 16, wherein the forward and aft cockpits are connected by a hinge.

19. The watercraft according to claim 16, wherein the forward cockpit comprises the vertically oriented outrigger guide tube.

20. The watercraft according to claim 1, wherein the outrigger comprises two arms, each attached to an ama.

* * * * *